United States Patent [19]

Hirai et al.

[11] Patent Number: 4,880,725

[45] Date of Patent: Nov. 14, 1989

[54] COLOR IMAGE FORMING PROCESS UTILIZING SUBSTANTIALLY WATER-INSOLUBLE BASIC METAL COMPOUNDS AND COMPLEXING COMPOUNDS

[75] Inventors: Hiroyuki Hirai; Haruhiko Iwano, both of Kanagawa, Japan

[73] Assignee: Fuji Photo Film Co., Ltd., Kanagawa, Japan

[21] Appl. No.: 291,311

[22] Filed: Dec. 27, 1988

Related U.S. Application Data

[63] Continuation of Ser. No. 225,576, Jul. 28, 1988, abandoned, which is a continuation of Ser. No. 21,884, Mar. 4, 1987, abandoned.

[30] Foreign Application Priority Data

Mar. 4, 1986 [JP] Japan ..... 61-46635
Nov. 27, 1986 [JP] Japan ..... 61-282260

[51] Int. Cl.[4] ..... G03C 1/00; G03C 5/42; G03C 5/26

[52] U.S. Cl. ..... 430/373; 430/17; 430/203; 430/351; 430/353; 430/376; 430/461; 430/462; 430/469; 430/487; 430/491; 430/492; 430/619; 430/936; 430/943

[58] Field of Search ..... 430/17 E, 203, 351, 430/353, 373, 376, 461, 462, 469, 487, 491, 492, 619, 936, 943

[56] References Cited

U.S. PATENT DOCUMENTS

| | | | |
|---|---|---|---|
| 3,260,598 | 7/1966 | Yutzy et al. | 430/231 |
| 4,045,225 | 8/1977 | Shimamura et al. | 430/373 |
| 4,062,684 | 12/1977 | Hara et al. | 430/373 |
| 4,084,969 | 4/1978 | Nakamura et al. | 430/373 |
| 4,219,615 | 8/1980 | Sakai | 430/373 |
| 4,371,609 | 2/1983 | Kajiwara et al. | 430/373 |
| 4,414,305 | 11/1983 | Nakamura et al. | 430/373 |
| 4,469,780 | 9/1984 | Hirai et al. | 430/373 |
| 4,529,687 | 7/1985 | Hirai et al. | 430/373 |
| 4,740,363 | 4/1988 | Hirai et al. | 430/203 |
| 4,740,445 | 4/1988 | Hirai et al. | 430/486 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A color image is formed by imagewise exposing a color photosensitive material comprising at least a silver halide and a coupler and subjecting the material to intensified development with a processing solution containing a reducing agent and an intensifier. A substantially water-insoluble basic metal compound is previously contained in the silver halide based color photosensitive material, while the processing solution contains a compound capable of complexing reaction with the metal ion of the substantially water-insoluble basic metal compound to release a base.

6 Claims, No Drawings

COLOR IMAGE FORMING PROCESS UTILIZING SUBSTANTIALLY WATER-INSOLUBLE BASIC METAL COMPOUNDS AND COMPLEXING COMPOUNDS

This is a continuation of application Ser. No. 07/225,576, filed July 28, 1988 which is a continuation of application Ser. No. 07/021,884, filed Mar. 4, 1987, both abandoned.

BACKGROUND OF THE INVENTION

This invention relates to a process for forming color images utilizing color intensification. More particularly, it relates to a process for forming high density color images by imagewise exposing a photosensitive material comprising a low content of silver halide and developing the material wherein redox reaction between a reducing agent and an intensifier is catalyzed by the developed silver.

Color image forming process of the multi-layer structure subtractive color mixing type utilizing color development is one of the most widely used color image forming processes. A number of attempts for saving the amount of silver used in photographic material have been made from various aspects, including use of 2-equivalent couplers, use of auxiliary agents capable of improving covering power application of toning technique, bleaching redevelopment, selection of a color material having a high coefficient of absorption, and the like.

In the image forming reaction, silver halide is a phototsensitive substance and at the same time, an oxidizing agent participating in dye formation. It has been proposed to save the amount of silver by substituting another compound for that fraction of the silver halide serving for the oxidizing function. It is known as a color intensified image forming process.

Oxidation of a paraphenylenediamine color developing agent by decomposition of hydrogen peroxide on catalyst surface in the presence of a coupler and subsequent formation of a dye by coupling with the coupler (this development is known as color intensification) is described in Friedman, "History of Color Photography", 2nd Ed. (1956), page 406. Other various photographic processes utilizing decomposition of peroxides on noble metal surface are described, inter alia, in West German patent application (OLS) Nos. 1,813,920, 1,950,102, 1,961,029, 2,044,833, 2,044,993, 2,056,360, 2,056,359, and 2,120,091.

Color intensification by cobalt complex salts on noble metal surface is described, inter alia, in Japanese patent application Kokai Nos. 48-9728, 48-9729, 48-48130, 49-84229, 49-84240, 49-97614, 49-102340, and 49-102314.

Color intensification by halogenous acids such as chlorous acid is described, inter alia, in Japanese patent application Kokai Nos. 51-53826 and 52-13335. Color intensification by iodoso compounds such as iodosobenzoic acid is described in Japanese patent application Kokai No. 52-73731.

These peroxides, halogenous acids, iodoso compounds, and cobalt (III) complexes are a class of compounds having intensifying ability which are known as intensifiers. Processing solutions containing such intensifiers are known as intensifying solutions or baths.

Among others, color image enhancing techniques utilizing the catalysis of peroxides and cobalt (III) complexes are most typical, and hydrogen peroxide intensification is believed best from the standpoint of amplification efficiency. These processes intensify images by imagewise exposing a silver halide photosensitive material, developing the material, the resultant developed silver serving as a catalyst, and efficiently producing an oxidized developing agent on the catalytic silver nuclei through redox reaction between an intensifier and a color developing agent, thereby forming a fully dense dye image. Thus, the intensifying treatment is generally a treating process involving immersing in an intensifying bath a color photosensitive material which has undergone color development or black-and-white development and then immersion in a color developing solution, whereby a latent image is first grown by development, the photosensitive material film coating is then caused to retain the color developing agent, and the color developing agent entrained with the photosensitive material is used to intensify images in the intensifying bath through redox reaction between the intensifier and the color developing agent on the developed silver nuclei.

To effectively carry out image intensification, it is necessary that a relatively large quantity of the developing agent is retained in the photosensitive material coating and hence, entrained into the intensifying bath and that the developing agent in the coating is rapidly oxidized on the catalytic silver nuclei by the intensifier before the developing agent diffuses away during intensification. One approach from this aspect is to use a highly oleophilic developing agent in a developing solution as disclosed in U.S. Pat. No. 3,816,134 and Japanese patent application Kokai No. 53-30333.

These intensifying baths are generally at an alkaline pH level, and it is desired to reduce their pH as low as possible for handling safety.

The image intensifying treatment has the disadvantage of adversely affecting simple processing because the intensifying bath immersing step adds one step to the conventional process. From the standpoint of simplifying intensification, U.S. Pat. No. 3,847,619 and 3,923,511 describe a technique of concurrently carrying out development, intensification and bleaching in a single bath using a cobalt (III) complex.

The possibility of simultaneously carrying out development and intensification in a single bath (mono bath) using hydrogen peroxide known to have a high amplification efficiency is indicated in West German Pat. No. 1,813,920 and Japanese patent application Kokai Nos. 52-13335 and 55-127555. However, little single bath developing/intensifying effect can be achieved in low silver content photosensitive material simply by adding hydrogen peroxide to a conventional color developing solution because of poisoning by potassium bromide present in the developing solution, usually in an amount of several hundred milligrams per liter.

One prior art method addressing this problem is a color intensified image forming process which can form satisfactory color images with less fog even in extremely low silver content color photosensitive materials at a high amplification factor, using a minimal number of processing baths as disclosed in Japanese patent application Kokai Nos. 58-18629, 58-127926, 58-137837, 58-140741, and 59-65843.

These image forming processes utilizing intensifiers have the advantage of saving the quantity of silver, but suffer from the disadvantage that the intensifiers used are unstable in aqueous solutions so that the intensifying solutions lose their activity in a very short time. This disadvantage is more severe particularly with peroxides having a high intensifying activity, and also occurs with cobalt (III) complexes having less activity than the peroxides.

In addition, a developing solution having a peroxide or another intensifier copresent with a developing agent, which is referred to as a combined developing-/intensifying solution, suffers from a further reduced lifetime.

SUMMARY OF THE INVENTION

An object of the present invention is to provide a quick, simple, inexpensive color image forming process which can extend the lifetime of a solution containing an intensifier, for example, an intensifying solution or combined developing/intensifying solution, and can simultaneously achieve stabilization and simplification of a color intensifying step.

According to the present invention, there is provided a process for forming a color image, comprising subjecting an imagewise exposed color photosensitive material comprising at least a silver halide and a coupler to intensified development in the presence of a reducing agent and at least one intensifier, characterized in that said silver halide color photosensitive material contains a substantially water-insoluble basic metal compound therein, and a processing solution containing the intensifier further contains a complexing compound capable of complexing reaction with the metal ion of said substantially water-insoluble basic metal compound to release a base.

DETAILED DESCRIPTION OF THE INVENTION

In the color image forming process of the present invention, a silver halide based color photosensitive material is exposed imagewise and then subjected to a developing/intensifying treatment in the presence of a reducing agent and at least one intensifier. According to the feature of the present invention, the silver halide based color photosensitive material having a substantially water-insoluble basic metal compound previously contained therein is treated with a processing solution containing the intensifier, more particularly, an intensifying solution or combined developing/intensifying solution, which further contains a compound capable of complexing reaction with the metal ion of the substantially water-insoluble basic metal compound to release a base.

It is desirable to incorporate the substantially water-insoluble basic metal compound as a fine particulate dispersion which may be prepared by the methods described in Japanese patent application Kokai Nos. 59-174830 and 53-102733. In such dispersions, the compounds preferably have an average particle size of 50 μm or less, especially 5 μm or less.

The amount of the basic metal compound added to the silver halide photosensitive material depends on the type and particle size of the compound, complexing reaction rate, and other factors. Preferably, the basic metal compounds are added in amounts of up to 50% by weight based on the weight of a coating of the photosensitive material, more preferably 0.01% to 40% by weight based on the weight of a coating of the photosensitive material.

The amount of the complexing compound added to the intensifying solution or combined developing/intensifying solution is preferably 0.005 mols to 5 mols per liter of the solution, and more preferably 0.05 mols to 2 mols per liter of the solution. If desired, the complexing compound may be combined with an alkaline agent selected from potassium carbonate, sodium carbonate, sodium bicarbonate, potassium phosphate, sodium metaborate, and borax.

In the image forming process of the present invention, a substantially water-insoluble basic metal compound and a compound capable of water-mediated complexing reaction with the metal ion of the substantially water-insoluble basic metal compound (to be referred to as complexing compound, hereinafter) are contacted in an image forming reaction system. Reaction of these compounds in the presence of water increases the pH of the reaction system.

By the term image forming reaction system used herein is meant a region where image forming reaction takes place. More particularly, it may correspond to that layer present on a support for the photosensitive material where color developing and intensifying reaction takes place.

The intensifying and combined developing/intensifying solutions are stable because they can be set to a lower pH level due to inclusion of the complexing compounds. Particularly, in the case of the combined developing/intensifying solution, the time for which the developing agent (which is a reducing agent) and the intensifier (which is an oxidizing agent) coexist in an alkaline solution can be shortened, resulting in a substantially extended solution lifetime.

The substantially water-insoluble basic metal compounds used in the present invention are those compounds having a solubility in water at 20° C. of up to 0.5 as expressed in grams of the compound dissolved in 100 grams of water. The preferred basic metal compounds are represented by the general formula:

$$T_mX_n$$

wherein T is a transition metal such as Zn, Ni, Al, Co, Fe, Mn, etc. or an alkaline earth metal such as Ca, Ba, Mg, etc.; X is a member that can form in water a counter ion to M as will be described in conjunction with the complexing compound and exhibits alkaline nature, for example, a carbonate ion, phosphate ion, silicate ion, borate ion, aluminate ion, hydroxy ion, and oxygen atom; and m and n are such integers as to establish equilibrium between the valences of T and X.

Some preferred, non-limiting examples of the substantially water-insoluble basic metal compounds include calcium carbonate, barium carbonate, magnesium carbonate, zinc carbonate, strontium carbonate, magnesium calcium carbonate $CaMg(CO_3)_2$; magnesium oxide, zinc oxide, tin oxide, cobalt oxide; zinc hydroxide, aluminum hydroxide, magnesium hydroxide, calcium hydroxide, antimony hydroxide, tin hydroxide, iron hydroxide, bismuth hydroxide, manganese hydroxide; calcium phosphate, magnesium phosphate; magnesium borate; calcium silicate, magnesium silicate; zinc aluminate, calcium aluminate; basic zinc carbonate $2\ ZnCO_3.3Zn(OH)_2.H_2O$, basic magnesium carbonate $3MgCO_3.Mg(OH)_2.3H_2O$, basic nickel carbonate $NiCO_3.2Ni(OH)_2$, basic bismuth carbonate $Bi_2(CO_3)O_2.H_2O$, basic cobalt carbonate $2CoCO_3.3Co(OH)_2$, and aluminum magnesium oxide. Most preferred among them are uncolored compounds.

The complexing compounds used in the present invention are capable of forming a complex salt with the metal component in ionic form of the substantially water-insoluble basic metal compounds, the complex exhibiting a stability constant of at least 1 as expressed in logK. These complexing compounds are detailed in A. E. Martell & R. M. Smith, "Critical Stability Constants", Vols. 1–5, Plenum Press, inter alia.

Illustrative examples of the complexing compounds include salts of aminocarboxylic acid analogs, iminodiacetic acid analogs, anilinecarboxylic acid analogs, pyridinecarboxylic acid analogs, aminophosphoric acid analogs, carboxylic acid analogs (including mono-, di-, tri-, and tetracarboxylic acids, and their derivatives having a substituent such as phosphono, hydroxy, oxo, ester, amide, alkoxy, mercapto, alkylthio, and phosphino), hydroxamic acid analogs, polyacrylic acid analogs, and polyphosphoric acid analogs with alkali metals, guanidines, amidines, and quaternary ammonium.

Preferred, non-limiting examples of the complexing compounds are salts of picolinic acid, 2,6-pyridinedicarboxylic acid, 2,5-pyridinedicarboxylic acid, 4-dimethylaminopyridine-2,6-dicarboxylic acid, quinoline-2-carboxylic acid, 2-pyridylacetic acid, oxalic acid, citric acid, tartaric acid, isocitric acid, malic acid, gluconic acid, EDTA (ethylenediaminetetraacetic acid), NTA (nitrilotriacetic acid), CDTA (1,2-cyclohexanediaminetetraacetic acid), hexametaphosphoric acid, tripolyphosphoric acid, tetraphosphoric acid, polyacrylic acid, and acids of the following chemical formulae:

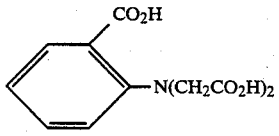

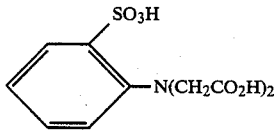

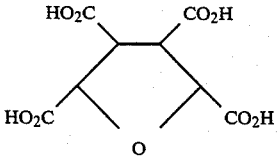

-continued

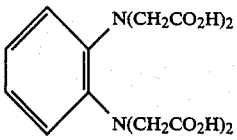

$HO_2CCH_2OCH_2CH_2OCH_2CO_2H$,
$HO_2CCH_2OCH_2CO_2H$,

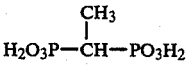

with alkali metals, guanidines, amidines, and quaternary ammonium.

Preferred among others are those aromatic heterocyclic compounds having at least one —COOM and containing one nitrogen atom in their ring wherein M is selected from ions of alkali metals, guanidines, amidines, and quaternary ammonium. The ring contained therein may be a single ring or a fused ring such as a pyridine ring and a quinoline ring. The position at which —COOM is attached to the ring is most preferably the α-position of the ring relative to the N atom.

Also included in the preferred compounds are those represented by the following formula:

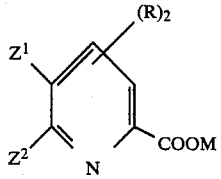

(I)

In the above formula, R represents an electron donative radical selected from hydrogen atom, aryl radicals, halogen atoms, alkoxy radicals, —COOM, hydroxycarbonyl radical, amino and substituted amino radicals, and alkyl radicals. The two R's may be the same or different. $Z^1$ and $Z^2$ are as defined for R and may be combined together to form a ring fused to the pyridine ring. M is as defined above.

Examples of the most preferred combinations of the substantially water-insoluble basic metal compounds and the complexing compounds are illustrated below. In the following formulae, $M^{\oplus}$ represents an alkali metal ion, substituted or unsubstituted guanidinium ion, amidinium ion, or quaternary ammonium ion.

| Substantially insoluble compound | Complexing compound |
|---|---|
| Calcium carbonate | 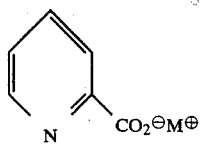  |
| Basic zinc carbonate | 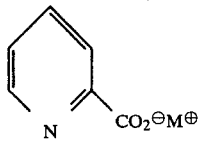  |

-continued

| Substantially insoluble compound | Complexing compound |
|---|---|
| Basic magnesium carbonate | 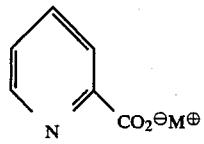 |
| Zinc hydroxide | 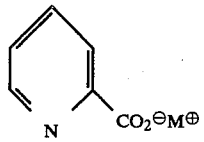 |
| Aluminum hydroxide | 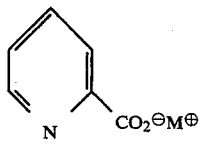 |
| Zinc oxide | 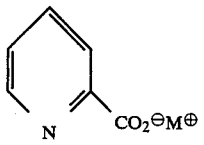 |
| Basic zinc carbonate | 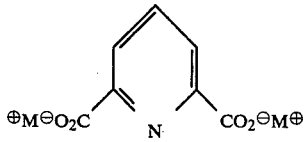 |
| Basic magnesium carbonate | 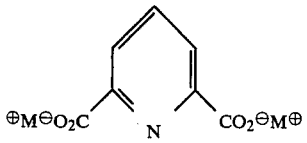 |
| Calcium carbonate | 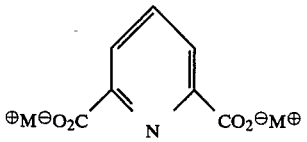 |
| Zinc oxide | 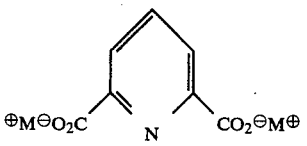 |
| Calcium carbonate | $^{\oplus}M^{\ominus}OOC—COO^{\ominus}M^{\oplus}$ |
| Calcium carbonate | 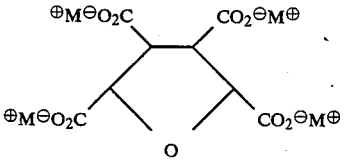 |
| Barium carbonate | $^{\oplus}M^{\ominus}OOC—COO^{\ominus}M^{\oplus}$ |
| Calcium carbonate | $M^{\oplus}$ salt of tripolyphosphoric acid |
| Calcium carbonate | $M^{\oplus}$ salt of citric acid |
| Calcium carbonate | $M^{\oplus}$ salt of polyacrylic acid |

-continued

| Substantially insoluble compound | Complexing compound |
|---|---|
| Calcium carbonate | 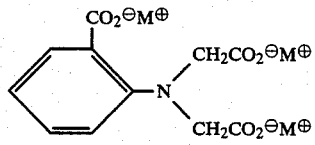 |
| Magnesium oxide | 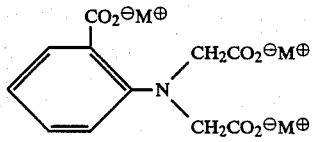 |
| Zinc hydroxide | 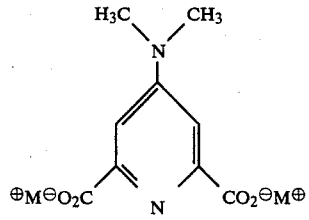 |
| Tin hydroxide | 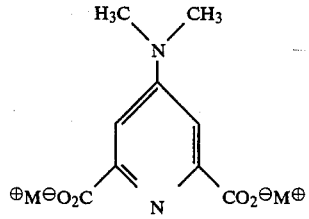 |
| Magnesium hydroxide | $M^{\oplus}$ salt of hexametaphosphoric acid |
| Calcium carbonate | 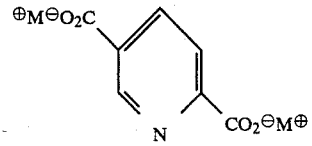 |
| Basic magnesium carbonate | $^{\oplus}M^{\ominus}OOC—COO^{\ominus}M^{\oplus}$ |
| Zinc hydroxide | $3M^{\oplus}$ salt of EDTA |
| Zinc hydroxide | $3M^{\oplus}$ salt of 1,2-CDTA |
| Calcium carbonate | 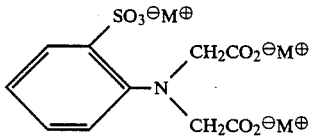 |
| Basic zinc carbonate | 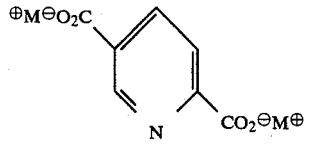 |

These combinations may be used alone or in admixture of two or more.

The mechanism of increasing the pH of the reaction system according to the present invention will be described by referring to one exemplary combination of potassium picolinate with zinc hydroxide. Their reaction may be represented by the following scheme:

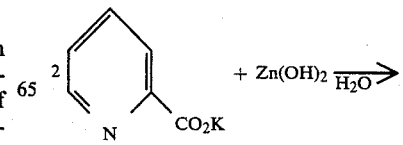

-continued

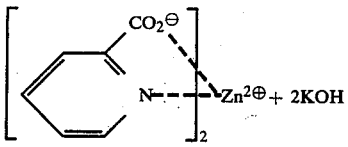

When potassium picolinate and zinc hydroxide are mediated by water in the processing solution, picolinate ions make a complexing reaction with zinc ions and the reaction proceeds according to the above-illustrated scheme, presenting a high alkaline level.

The progress of this reaction is attributable to the stability of the resulting complexes. Picolinate ions ($L^-$) and zinc ions ($M^+$) form complexes ML, $ML_2$, and $ML_3$ having a very high stability constant as shown below, which well accounts for the progress of the reaction.

| | ML | $ML_2$ | $ML_3$ |
|---|---|---|---|
| logK | 5.30 | 9.62 | 12.92 |

The intensifiers used in the progress of the present invention may be any well-known intensifiers. Typical of the intensifiers are peroxides such as hydrogen peroxide, cobalt (III) complexes, halogenous acid salts, and polyvalent iodine compounds.

The intensifier may be partially or entirely incorporated into the photosensitive material or contained in an intensifying solution or combined developing/intensifying solution. However, it is advantageous to incorporate the intensifier into the intensifying solution or combined developing/intensifying solution when the shelf stability of the photosensitive material is taken into account.

The intensifiers used herein will be described in detail.

One class of intensifiers is peroxides including hydrogen peroxide and compounds which release hydrogen peroxide upon contact with water. Examples of these hydrogen peroxide-releasing compounds include compounds having $O_2^{2-}$ such as $Li_2O_2$, $Na_2O_2$, $K_2O_2$, $Rb_2O_2$, $Cs_2O_2$, $MgO_2$, $CaO_2$, $SrO_2$, $BaO_2$, $ZnO_2$and $CrO_5$; compounds having $O_2^-$ such as $NaO_2$, $KO_2$, and $CaO_4$; dialkyl peroxides such as diethyl peroxide and di-tert.-butyl peroxide; peroxo acids such as peroxobenzoic acid, peroxacetic acid, peroxoformic acid, peroxonitric acid, peroxosulfuric acid, peroxodisulfuric acid, peroxophosphoric acid, peroxodiphosphoric acid, peroxocarbonic acid, peroxotitanic acid, and peroxoboric acid and their salts, particularly their salts with alkali metals, alkaline earth metals, and ammonium.

The amount of peroxide used herein varies with the type of peroxide and the addition form. When incorporated in the photosensitive material, the peroxide is preferably present in an amount of up to 50% by weight based on the weight of a coating of the photosensitive material, more preferably from 0.01% to 40% by weight based on the weight of a coating of the photosensitive material. When incorporated in the developing/intensifying solution, the peroxide is preferably present at a concentration of from $2\times10^{-3}$ mol/liter to 10 mol/liter, preferably from $1\times10^{-2}$ mol/liter to 5 mol/liter. The term "developing/intensifying solution" used herein is intended to encompass both intensifying solution and combined developing/intensifying solution. When added to the combined developing/intensifying solution, the peroxide is desirably used in such amounts that the molar ratio of the peroxide to the color developing agent is from 0.05 to 200, especially from 0.5 to 80.

In the present invention, it is preferable to add a stabilizer for the peroxides. Such stabilizers are the compounds described in W. C. Schumb, "Hydrogen Peroxide", 515–547, Research Disclosure, No. 11660, organic phosphonic acids and analogs described in Japanese Patent Application Kokai Nos. 52-10523 and 55-127555, as well as aminocarboxylic acids such as ethylenediamine tetraacetic acid (EDTA), nitrilotriacetic acid, cyclohexanediamine tetraacetic acid, iminodiacetic acid, hydroxyethyliminodiacetic acid, hydroxyethylethylenediamine triacetic acid, glycoletherdiamine tetraacetic acid, diethylenetriamine pentaacetic acid, triethylenetetramine hexaacetic acid, diaminopropanol tetraacetic acid, and ethylenediaminedioorthohydroxyphenyl acetic acid, and their salts. The stabilizer is preferably added in such amounts that the molar ratio of stabilizer to peroxide is from 0.001 to 10, especially from 0.01 to 1.

A second class of intensifiers is cobalt (III) complexes. Typical complexes are described in Japanese Patent Application Kokai No. 48-9728.

Particularly useful cobalt (III) complexes are those having a coordinate valence of 6 and a ligand selected from ethylenediamine, diethylenetriamine, triethylenetetramine, propylenediamine, ammonia, nitrate ion, nitrite ion, azido ion, chloride ion, thiocyanate ion, isothiocyanate ion, carbonate ion, and water. Among them are cobalt (III) ammine complexes of the following formulae:

$[Co(NH_3)_5H_2O]X_{3/n}$, $[Co(NH_3)_5CO_3]X_{1/n}$, $[Co(NH_3)_5Cl]X_{2/n}$, and $[Co(NH_3)_5CO_3]X_{1/n}$, where X is an anion such as a bromide ion, chloride, ion, nitrate ion, thiocyanate ion, dithionate ion, and hydroxide ion, and n represents the valence of the anion.

Most preferred cobalt (III) complexes are those wherein at least 3, especially at least 5 coordination sites are occupied by ammine ($NH_3$) ligands and/or the complex ion has a positive valence, especially of +3. These cobalt (III) complexes may be added to the photosensitive material in the form of a water-insoluble ion pair as described in U.S. Pat. No. 307,894.

The amount of cobalt (III) complex used herein varies with the type of cobalt (III) complex and the addition form. When incorporated in the photosensitive material, the cobalt (III) complex is preferably present in an amount of up to 50% by weight based on the weight of a coating of the photosensitive material, more preferably from 0.01% to 40% by weight based on the weight of a coating of the photosensitive material. When incorporated in the developing/intensifying solution, the cobalt (III) complex is preferably present at a concentration of from $1\times10^{-4}$ mol/liter to $5\times10^{-1}$ mol/liter, preferably from $1\times10^{-3}$ mol/liter to $1\times10^{-1}$ mol/liter. When added to the combined developing/intensifying solution, the cobalt (III) complex is desirably used in such amounts that the molar ratio of the cobalt (III) complex to the dye-providing substance is from 0.01 to 200, especially from 0.1 to 80.

A third class of intensifiers is halogenous acid salts. Typical examples are described in Japanese Patent Application Kokai No. 51-53826. Particularly useful halogenous acid salts are chlorous acid salts or chlorites while examples of the counter ion include ions of alkali metals such as lithium, sodium and potassium; alkaline earth metals such as magnesium, calcium, strontium, and barium; ammonium, quaternary alkylammonium, guanidium, and amidinium. Most preferred among them are sodium chlorite and potassium chlorite.

The amount of halogenous acid salt used herein varies with the type of halogenous acid salt and the addition form. When incorporated in the photosensitive material, the halogenous acid salt is preferably present in an amount of up to 50% by weight based on the weight of a coating of the photosensitive material, more preferably from 0.01% to 40% by weight based on the weight of a coating of the photosensitive material. When incorporated in the developing/intensifying solution, the halogenous acid salt is preferably present at a concentration of from $1\times10^{-3}$ mol/liter to 6 mol/liter, preferably from $1\times10^{-2}$ mol/liter to 3 mol/liter. When added to the combined developing/intensifying solution, the halogenous acid salt is desirably used in such amounts that the molar ratio of the halogenous acid salt to the color developing agent is from 0.01 to 200, especially from 0.1 to 80.

A fourth class of intensifiers is polyvalent iodine compounds. Typical are compounds of iodine atoms having a valence of +3, +5 or +7 as described in Japanese Patent Application Kokai No. 52-73731. Particularly useful polyvalent iodine compounds are those of general formula (II):

$$R-(-Z)_n \qquad \text{(II)}$$

where R is a substituted or unsubstituted alkenyl radical having 2 to 10 carbon atoms, a substituted or unsubstituted aryl radical having 6 to 18 carbon atoms including monocyclic ones and polycyclic ones of 5- or 6-membered rings, or a substituted or unsubstituted heterocyclic radical, preferably 5- or 6-membered nitrogeneous heterocyclic radical. Exemplary substituents on these radicals are chlorine, alkyl, carboxyl, sulfo, cyano, nitro, acylamino, acyl, phenylazo, and acylsulfonyl radicals.

In formula (II), Z is selected from the group consisting of:

$$-IO,\ -IO_2,\ -IX_2,\ \text{and}\ -I^{\oplus}-R'.Y^{\ominus}$$

where

X represents chlorine or an acyloxy radical which is an acyloxy radical having an alkyl or aryl moiety containing 1 to 8 carbon atoms and an optional substituent like Cl;

$Y^{\ominus}$ represents a monovalent anion such as $Cl^-$ and $CH_3COO^-$;

R′ represents a substituted or unsubstituted alkenyl radical having 2 to 10 carbon atoms, or a substituted or unsubstituted aryl radical including monocyclic ones and polycyclic ones of 5- or 6-membered rings.

Among the compounds of formula (II), better results are obtained with those aromatic polyvalent iodine compounds wherein R is an aryl radical or aromatic heterocyclic radical because of their stability.

Examples of the polyvalent iodine compounds which may be used herein are listed below.

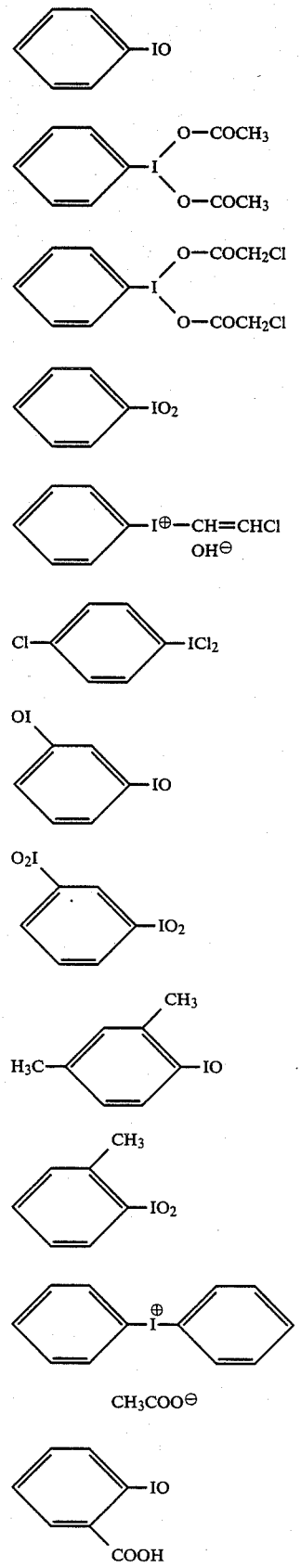

-continued
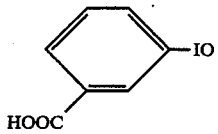
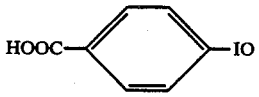
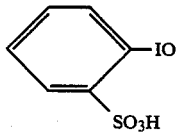
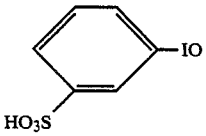
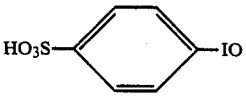
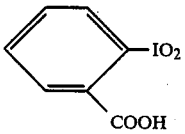
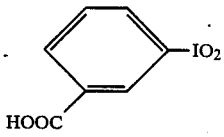
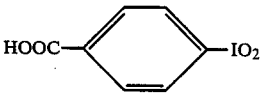
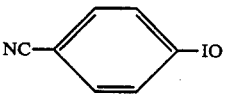
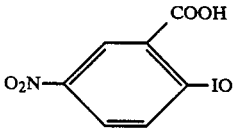
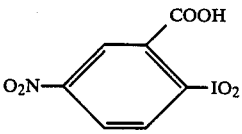
-continued
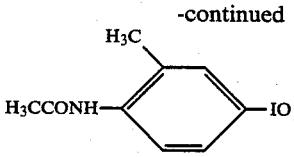
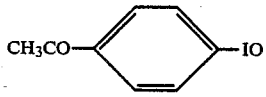
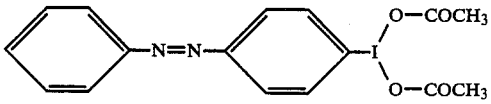
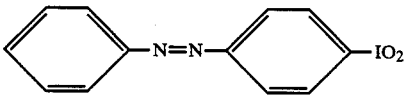
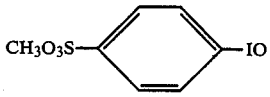
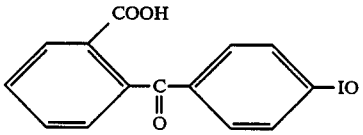
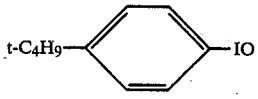
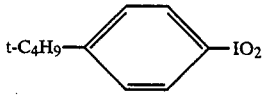
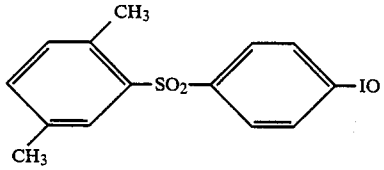
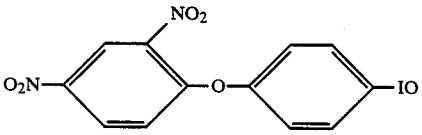
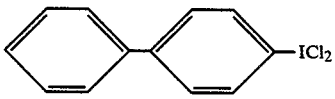
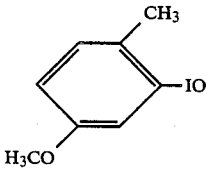

-continued

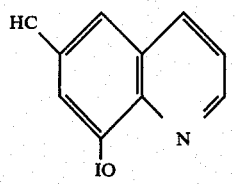

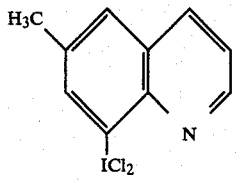

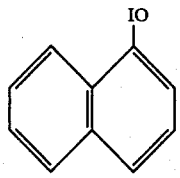

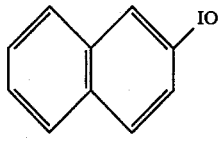

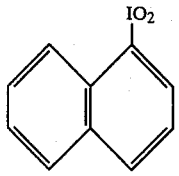

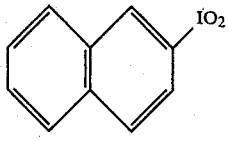

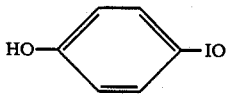

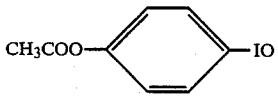

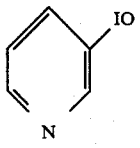

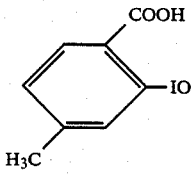

-continued

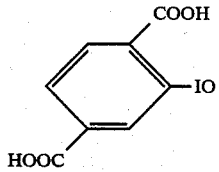

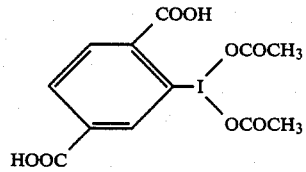

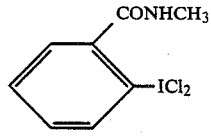

Among the above-listed compounds, those having an acid substituent such as —COOH and —$SO_3H$ may be salts wherein the hydrogen atom or ion is replaced by an alkali metal ion, an alkaline earth metal ion, a quaternary ammonium ion, or a guanidium ion.

The above-listed compounds may be synthesized by any conventional well-known methods. Typical synthetic methods are described in, for example,

*Organic Synthesis Collection,* Vol. III, pages 482–487;

*Organic Synthesis Collection,* Vol. V, pages 658–663 and 665–667; and

Fieser & Fieser, "Reagents for Organic Synthesis", pages 506–511.

The amount of polyvalent iodine compound used herein varies with the type of polyvalent iodine compound and the addition form. When incorporated in the photosensitive material, the polyvalent iodine compound is preferably present in an amount of up to 50% by weight based on the weight of a coating of the photosensitive material, more preferably from 0.01% to 40% by weight based on the weight of a coating of the photosensitive material. When incorporated in the developing/intensifying solution, the polyvalent iodine compound is preferably present at a concentration of from $1\times10^{-4}$ mol/liter to 1 mol/liter, preferably from $1\times10^{-3}$ mol/liter to $5\times10^{-1}$ mol/liter. When added to the combined developing/intensifying solution, the polyvalent iodine compound is desirably used in such amounts that the molar ratio of the polyvalent iodine compound to the color developing agent is from 0.01 to 200, especially from 0.1 to 80.

In the practice of the present invention, the photosensitive material and/or the developing/intensifying solution may contain any antifoggants as described in Japanese Patent Application Kokai Nos. 52-13335, 53-19829, and 58-18629. Particularly, although it is desired that the combined developing/intensifying solution is substantially free of a bromide or iodide ion, the solution may contain up to about $2\times10^{-4}$ mol/liter of a halide ion. Preferred among the known antifoggants are the nitrogeneous heterocyclic compounds of general formulae (I) through (XV) described in Japanese Patent Application Kokai No. 58-18629.

The amount of antifoggant added to the photosensitive material is not critical and varies with the type of silver halide, the amount of silver coated, and the type of antifoggant although the antifoggant is preferably used in an amount of $10^{-8}$ to $10^{-2}$ mol per square meter, more preferably $10^{-7}$ to $10^{-3}$ mol per square meter. Also, the amount of antifoggant added to the developing/intensifying solution is not critical although it is preferably used in an amount of of $10^{-6}$ to $10^{-1}$ mol/liter, more preferably $10^{-5}$ to $10^{-2}$ mol/liter.

In the practice of the present invention, for the purpose of removing bromide and iodide ions from the developing/intensifying solution, the solution may be contacted with an anion exchanger during the process.

The shape of the anion exchanger used in the practice of the present invention is not particularly limited and may be granular, fibrous, membrane, tubular, pellet and other shapes. The anion exchangers may be polymers including anion exchange resins, anion exchange membranes, and adsorption resins although the anion exchange resins which can completely remove $Br^-$ and $I^-$ within a short time are desirable. The anion exchange resins which may be used herein are strongly basic polystyrene resins, weakly basic polystyrene resins, weakly basic polyacrylic resins, weakly basic phenol resins, and moderately basic epoxypolyamine resins. Preferred are the strongly basic anion exchange resins, most preferably those resins based on polystyrene or polystyrene/divinylbenzene and having a dimethylethanolammonium or trimethylammonium group as an active exchange group.

These exchange resins are described, for example, in U.S. Pat. No. 3,253,920 and West German Pat. No. 1,054,715. The anion exchange resins which are received in Cl and OH forms from commercial sources may be used with or without a pre-treatment of converting the resins to $SO_4$, $CO_3$ and $PO_4$ forms. The manner of using the anion exchange resin is not critical as long as the developing/intensifying solution is in substantial contact with the anion exchange resin. For example, the anion exchange resin may be used by applying in a sheet form to the wall of a processing tank or charging a column with the resin. In the latter case, the developing/intensifying solution is circulated between the column and the processing tank.

The amount of ion exchanger used in the practice of the present invention is not particularly limited because it depends on the halide ion exchangeability of the exchanger, the silver halide content of the photosensitive material, the amount of the developing/intensifying solution applied per unit area of the photosensitive material and other factors. Usually, about 1 gram to 500 grams of the ion exchanger is used per liter of the developing/intensifying solution.

In the practice of the present invention, the photosensitive material may contain a cationic polymer. The cationic polymers used herein are polymers having secondary and tertiary amino groups, polymers having a nitrogeneous heterocyclic moiety, and similar polymers having a quaternary cation group, the polymers having a molecular weight in the range of from 5,000 to 1,000,000, preferably 10,000 to 200,000.

Examples of the cationic polymers used herein include vinyl pyridine polymers and vinyl pyridinium cationic polymers as disclosed in U.S. Pat. Nos. 2,548,564, 2,484,430, 3,148,061, and 3,756,814; vinyl imidazolium cationic polymers as disclosed in U.S. Pat. No. 4,124,386; polymeric mordants cross-linkable with gelatin or the like as disclosed in U.S. Pat. Nos. 3,625,694, 3,859,096, and 4,128,538 and British Pat. No. 1,277,453; aqueous sol type mordants as disclosed in U.S. Pat. Nos. 3,958,995, 2,721,852, and 2,798,063, Japanese Patent Application Kokai Nos. 54-115228, 54-126027, 54-145529, 54-155835, and 56-17352; water-insoluble mordants as disclosed in U.S. Pat. No. 3,898,088; and other mordants as disclosed in U.S. Pat. Nos. 3,271,147, 3,271,148, 3,488,706, 3,557,066, 3,642,482, 3,709,690, and 3,788,855, and Japanese Patent Application Kokai Nos. 52-155528, 53-125, 53-1024, 53-30328, and 53-107835, and British Pat. No. 2,064,802. Also useful are the mordants described in U.S. Pat. Nos. 2,675,316 and 2,882,156.

Preferred among these cationic polymers are those which do not readily move from the polymer-containing layer to another layer, for example, cationic polymers which give rise to crosslinking reaction with gelatin or another matrix, water-insoluble cationic polymers, and aqueous sol or latex dispersion type cationic polymers.

In the practice of the present invention, the developing/intensifying treatment is conducted at a temperature usually ranging from 18° C. to 50° C. although lower or higher temperatures may be used.

The intensifying solution or combined developing/intensifying solution generally has a pH in the range between 5 and 13, preferably between 6 and 11.

The developing/intensifying solution may further contain any compounds which are known as ingredients of conventional developing solution. For example, an alkaline agent or buffering agent may be contained, examples of which include caustic soda, potassium carbonate, sodium quinolinate, potassium secondary phosphate, sodium tertiary phosphate, potassium tertiry phosphate, phosphoric acid, sodium pyrophosphate, potassium pyrophosphate, potassium metaborate, sodium metaborate, and borax.

The developing/intensifying solution may contain any development accelerators if desired. Examples of the accelerators include various pyridinium compounds and other cationic compounds, cationic dyes such as phenosafranine, and neutral salts such as thallium nitrate and potassium nitrate as typified by U.S. Pat. No. 2,648,604, Japanese Patent Publication No. 44-9503, and U.S. Pat. No. 3,671,247; nonionic compounds such as polyethylene glycol and derivatives thereof and polythioethers as described in Japanese Patent Publication No. 44-9504, U.S. Pat. Nos. 2,533,990, 2,531,832, 2,577,127, and 2,950,970; organic solvents and organic amines as described in Japanese Patent Publication No. 44-9509 and Belgian Pat. No. 682,862; the accelerators described in L.F.A. Mason, Photographic Processing Chemistry, Focal Press-London, 1966, pages 40–43; benzylalcohol and phenylethyl alcohol as described in U.S. Pat. No. 2,515,147; and pyridines, ammonias, hydrazines, and amines as described in Journal of Japanese Photographic Society, Vol. 14 (1952), page 74. It is also possible to add the salts of hydroxylamine with sulfuric acid and hydrochloric acid, sodium sulfite, potassium sulfite, potassium bisulfite, and sodium bisulfite.

If desired, the developing/intensifying solution may contain any additional ingredients as listed below. Exemplary additional ingredients are:

competitive couplers including citrazinic acid, J acid, and H acid as disclosed in Japanese Patent Publication Nos. 44-508, 44-9505, 44-9506, 44-9507, and 45-14036; U.S. Pat. Nos. 2,742,832, 3,520,690, 3,560,212, and 3,645,737;

fogging agents such as alkali metal borohydrides, aminoboran, and ethylenediamine as described in Japanese Patent Publication No. 47-38816;

auxiliary developing agents such as p-aminophenol, benzyl-p-aminophenol, and 1-phenyl-3-pyrazolidone as illustrated in Japanese Patent Publication Nos. 45-41475, 46-19037, and 46-19438;

surface-active agents, defoaming agents, and the like.

Any reducing agents may be used in the practice of the present invention. There are encompassed p-phenylenediamine derived color developing agents; p-aminophenol derived color developing agents convertible to onium salts as described in U.S. Pat. No. 3,791,827; dye developing agents as described in U.S. Pat. No. 2,983,606; diffusible dye-releasing (DDR) redox compounds as described in Japanese Patent Application Kokai No. 48-33826; amidolazone-reacting developing agents as described in Japanese Patent Publication No. 48-39165; reducing agents of the type which themselves oxidize to form a dye or lake, for example, tetrazonium salts, 2,4-diaminophenol, and α-nitroso-β-naphthol leuco dyes; and reducing agents capable of forming a colored image after oxidation as described in Japanese Patent Application Kokai No. 47-6338, pages 9–13. Among these reducing agents, some developing agents must themselves be oxidized and coupled with a coupler to form a dye, some oxidize by themselves to form a dye, and some previously colored developing agents are oxidized into a non-diffusing dye.

Typical examples of the p-phenylenediamine derived color developing agents include 2-amino-5-diethylaminotoluene hydrochloride, 2-amino-5-(N-ethyl-N-laurylamino)toluene, 4-[N-ethyl-N-(β-hydroxyethyl-)amino]aniline hydrogensulfate, 2-methyl-4-[N-ethyl-N-(β-hydroxyethyl)amino]aniline hydrogensulfate; N-ethyl-N(β-methanesulfonamidethyl)-3-methyl-4-aminoaniline sesquisulfate monohydrate described in U.S. Pat. No. 2,193,015; N-(2-amino-5-diethylamino-phenylethyl)methane sulfonamide hydrogensulfate and N,N-dimethyl-p-phenylenediamine hydrochloride described in U.S. Pat. No. 2,529,364; 4-amino-3-methyl-N-ethylmethoxyethylaniline, 4-amino-3-methyl-N-ethyl-N-β-ethoxyethylaniline and 4-amino-3-methyl-N-ethyl-N-β-butoxyethylaniline and their salts such as sulfuric acid, hydrochloric acid, sulfurous acid and p-toluenesulfonic acid salts as described in U.S. Pat. Nos. 3,656,950 and 3,698,525. Also useful are those reducing agents described in L.F.A. Mason, *Photographic Processing Chemistry,* Focal Press (1966), pages 226–229.

The reducing agents includes those of the type which themselves forms a color image upon oxidation and those of the other type which forms a complex with a metal salt. Examples of the latter type include the developing agents described in British Pat. No. 1,210,417, tetrazonium salts described in U.S. Pat. No. 3,655,382, and 2,4-diaminophenol, α-nitroso-β-naphthol, and the like. These reducing agents are the compounds that are oxidized by an intensifying agent in the presence of a catalyst, but oxidized only at an extremely slow rate in a catalyst-free region and that are themselves image-forming elements or whose oxidized product reacts with a coupler to form an image.

The amount of reducing agent used preferably ranges from 0.01 to 20 mol, more preferably from 0.1 to 10 mol per mol of silver when added to the photosensitive material, and from 0.01 gram/liter to 50 gram/liter, more preferably from 0.1 gram/liter to 20 gram/liter when added to the solution.

The photosensitive material may contain any auxiliary developing agents. Examplary of the auxiliary developing agents there may be given hydroquinone, alkyl-substituted hydroquinones such as t-butylhydroquinone, 2,5-dimethylhydroquinone, catechols, pyrogallols, halogenated hydroquinones such as chlorohydroquinone and dichlorohydroquinone, alkoxy-substituted hydroquinones such as methoxyhydroquinone, and polyhydroxybenzene derivatives such as methylhydroxynaphthalene. Also useful are methyl gallate, ascorbic acid, ascorbic acid derivatives, hydroxylamines such as N,N'-di-(2-ethoxyethyl)hydroxylamine, pyrazolidones such as 1-phenyl-3-pyrazolidone and 4-methyl-4-hydroxymethyl-1-phenyl-3-pyrazolidione, reductones, and hydroxytetronic acids.

In the photographic material of the present invention, the amount of silver coated is up to 1 gram per square meter, especially up to 0.5 grams per square meter. In the case of multi-layered photosensitive materials, the amount of silver coated is up to 1 gram per square meter of each photosensitive layer, especially 1 mg to 0.5 grams per square meter of each photosensitive layer.

A silver halide emulsion is generally prepared by mixing a water-soluble silver salt (e.g., silver nitrate) solution with a water-soluble halide salt (e.g., potassium bromide) solution in the presence of a water-soluble polymeric substance (e.g., gelatin) solution. The silver halides used in the present invention include silver chloride, silver bromide, and combined silver halides such as silver chlorobromide, silver iodobromide, and silver chloroiodobromide, but not limited thereto. The average particle size of silver halide grains, which corresponds to a particle diameter for spherical or near spherical particles or a side length for cubic particles and represented by an average based on projected areas, is preferably up to 2 μm, most preferably up to 0.4 μm. The particle size distribution may be either narrow or broad.

The silver halide grains may have any crystalline shape selected from cubic, octahedral and their combined crystal shape as well as plate shape (plates having a thickness of up to 0.5 μm, a diameter of at least 0.6 μm, and an average aspect ratio of at least 5).

The silver halide grains may have any crystalline structures including a homogeneous structure which is uniform from the outside to the inside, a laminar structure wherein the outside and the inside are heterogeneous, and a conversion type structure as described in British Pat. No. 635,841 and U.S. Pat. No. 3,622,318. The silver halide emulsions used in the practice of the present invention may be either of the surface latent image type wherein latent images are predominantly formed on the grain surface or of the internal latent image type wherein latent images are formed in the grain interior. These photographic emulsions are described in publications, for example, Mees, "The Theory of Photographic Process", Macmillan Press, and P. Grafkides, "Chimie Photographique", Paul Montel (1957); and may be prepared by generally accepted methods as described in P. Grafkides, "Chimie et Physique Photographique", Paul Montel (1967), G. F. Duffin, "Photographic Emulsion Chemistry", The Focal Press (1966), and V. L. Zelikman et al., "Making and Coating Photographic Emulsion", The Focal Press (1964). More particularly, any methods including acid, neutral and ammonia methods may be used, and the mode of reaction of a soluble silver salt with a soluble halide salt may be single jet mixing, double jet mixing, and a combination thereof.

Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

It is possible to mix two or more separately prepared silver halide emulsions.

In the step of forming or physically ripening silver halide grains, there my coexist a cadmium salt, zinc salt, lead salt, thallium salt, iridium salt or its complex salt, rhodium salt or its complex salt, iron salt or its complex salt.

The emulsion is generally removed of soluble salts after precipitation or physical ripening. Soluble salt removal means may be a traditional Nudel rinsing method using gelled gelatin or a flocculation method using an inorganic salt of a polyvalent anion (such as sodium sulfate), an anionic surface-active agent, an anionic polymer (such as polystyrene sulfonic acid), or a gelatin derivative (such as aliphatic acylated gelatin, aromatic acylated gelatin, and aromatic carbamoylated gelatin). The soluble salt removal step may be omitted.

The silver halide emulsion may be a primitive emulsion that has not been subject to chemical sensitization, but is usually chemically sensitized. Chemical sensitization may be carried out by the methods described in the above-incorporated publications of Glafkides and Zelikman et al. as well as H. Frieser ed., "Die Grundlagen der Photograhischen Prozesse mit Silverhalogeniden", Akademische Verlagsgesellschaft, 1968. For chemical sensitization purpose, there may be employed sulfur sensitization using a sulfur-containing compound capable of reacting with silver ion and active gelatin, reducing sensitization using a reducing material, noble metal sensitization using a compound of gold or another noble metal, and combinations thereof.

The development nucleus used herein may be colloidal silver and photo-degraded palladium nucleus as well as developed silver and exposed silver halide emulsion.

A coupler may be used in the practice of the present invention for the purpose of dye image formation.

The couplers used herein are color forming couplers as given below, that is, compounds which develop color through oxidative coupling with aromatic primary amine developing agents (e.g., phenylenediamine derivatives and aminophenol derivatives) during color developing treatment, and more particularly, magenta couplers, for example, 5-pyrazolone couplers, pyrazolone benzimidazole couplers, cyanoacetylchroman couplers, open chain acylacetonitrile couplers, etc.; yellow couplers, for example, acylacetamide couplers such as benzoylacetanilides and pivaloyl acetanilides, etc.; and cyan couplers, for example, naphthol couplers and phenol couplers. These couplers are desirably non-diffusing ones having a hydrophobic group generally known as a ballast group in their molecule or polymerized ones. The couplers may be of either 4- or 2-equivalent to silver ion. Also included are colored couplers having a color correcting effect and couplers which release development inhibitors during development and are generally known as DIR couplers. In addition to the DIR couplers, colorless DIR coupling compounds which give colorless products of coupling reaction while releasing development inhibitors are encompassed.

The couplers may be used in various ways. For example, a mixture of two or more couplers may be contained in a common layer to meet the characteristics desired for a particular photosensitive material. It is also possible to add the same compound to two or more different layers.

It has been found that the intensifying treatment according to the present invention becomes more effective when 2-equivalent couplers are used among others.

The term 2-equivalent coupler designates a coupler in which an active coupling position is replaced by a coupling split-off group other than a hydrogen atom.

The coupling split-off group of the 2-equivalent coupler (to be simply referred to as coupling-off group, hereinafter) is an aliphatic group, aromatic group, heterocyclic group, aliphatic-aromatic or heterocyclic sulfonyl group, aliphatic-aromatic or heterocyclic carbonyl group, halogen atom, or aromatic azo group which is attached to the coupling active carbon via an oxygen, nitrogen, sulfur or carbon atom. The aliphatic, aromatic and heterocyclic groups contained in these coupling-off groups may be substituted or unsubstituted.

Illustrative examples of the coupling-off groups include halogen atoms such as flourine, chlorine, and bromine; alkoxy groups such as ethoxy, dodecyloxy, methoxyethylcarbamoylmethoxy, carboxypropyloxy, and methylsulfonylethoxy groups; aryloxy groups such as 4-chlorophenoxy, 4-methoxyphenoxy, and 4-carboxyphenoxy groups; acyloxy groups such acetoxy, tetradecanoyloxy, and benzoyloxy groups; aliphatic or aromatic sulfonyloxy groups such as methanesulfonyloxy and toluenesulfonyloxy groups; acylamino groups such as dichloroacetylamino and heptafluorobutyrylamino groups; aliphatic or aromatic sulfonamide groups such as methanesulfonamino and p-toluenesulfonamino groups; alkoxycarbonyloxy groups such as ethoxycarbonyloxy and benzyloxycarbonyloxy groups; aryloxycarbonyloxy groups such as a phenoxycarbonyloxy group; aliphatic-aromatic or heterocyclic thio groups such as ethylthio, phenylthio, and tetrazolylthio groups; carbamoylamino groups such as N-methylcarbamoylamino and N-phenylcarbamoylamino groups; 5- or 6-membered nitrogeneous heterocyclic groups such as imidazolyl, pyrazolyl, triazolyl, tetrazolyl, and 1,2-dihydr-2-oxo-1-pyridyl groups; imide groups such as succinimide and hydantoinyl groups; aromatic azo groups such as a phenylazo group, with all these groups being optionally substituted. Another class of the coupling-off groups attached via a carbon atom is bis-type couplers obtained by condensing 4-eqivalent couplers with aldehydes or ketones. The coupling-off groups may further contain a photographically useful group such as a development restrainer and a development accelerator.

Preferred are the above-listed coupling-off groups other than the halogen atoms, the coupling-off group being attached to the coupling position via an oxygen, nitrogen, sulfur or carbon atom. Couplers having these coupling-off groups have such a high solubility in a coupler dispersing solvent that the amount of the coupler dispersing solvent used may be reduced, with the advantages of increased sharpness and more effective utilization of the base resulting from the present mechanism in the image forming reaction system.

Examples of the coupling-off groups other than the halogen atoms are disclosed in the following patent publications.

| | | |
|---|---|---|
| Japanese Patent Application Kokai Nos. | | |
| 47-26133 | 50-10135 | 50-117422 |
| 50-159336 | 51-3232 | 51-20826 |
| 52-20023 | 52-58922 | 52-90932 |
| 53-129035 | 55-32071 | 55-62454 |
| 55-161239 | 55-118034 | 56-1938 |
| 57-35858 | 58-95346 | 59-174839 |
| 59-178459 | 59-214854 | 59-228649 |
| 59-231538 | 60-23855 | 60-35730 |
| 60-49336 | 60-69653 | 60-91355 |
| Japanese Patent Publication Nos. | | |
| 48-25933 | 49-12660 | 49-13576 |
| 51-33410 | 54-21257 | 54-37822 |
| 56-5988 | 56-6539 | 56-7222 |
| 56-45135 | 57-37859 | |
| | U.S. Pat. Nos. | |
| 3,227,554 | 3,311,476 | 3,408,194 |
| 3,447,928 | 3,476,563 | 3,458,315, |
| 3,542,840 | 3,737,316 | 3,758,308 |
| 3,839,044 | 3,894,875 | 3,994,967 |
| 4,133,958 | 4,401,752 | |

Especially preferred coupling-off groups are those having the general formulae (III) to (VI) as given below.

General formula (III):

—SR1

In formula (III), R1 represents a straight chain or branched alkyl group having 1 to 22 carbon atoms which may be optionally substituted. Examples of the straight chain alkyl groups are methyl, ethyl, propyl, butyl, octyl, dodecyl, tetradecyl, octadecyl, and hpetadecyl groups. Examples of the branched alkyl groups are iso-propyl and tert.-butyl groups. In addition, R1 may represent an aralkyl group such as a benzyl and 2-phenylethyl group; an alkenyl group such as a propenyl group; and an aryl group such as a phenyl group.

These alkyl, aralkyl, alkenyl, and aryl groups may be replaced with a substituent selected from the class consisting of halogen atoms, nitro, cyano, aryl, alkoxy, aryloxy, carboxy, alkylcarbonyl, arylcarbonyl, alkoxycarbonyl, aryloxycarbonyl, acyloxy, sulfamoyl, carbamoyl, acylamino, diacylamino, ureido, thioureido, urethane, thiourethane, sulfonamide, heterocyclic, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, and hydroxy groups.

General formula (IV):

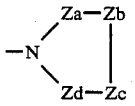

In formula (IV), Za to Zd represent methine, substituted methine, and —N= groups. The nitrogeneous ring formed by Za to Zd may further form a fused ring, and Za to Zd may be the same or different. Preferred examples of these coupling-off groups include 1-imidazolyl, 2-methyl-1-imidazolyl, 2-methyl-thio-1-imidazolyl, 2-ethylthio-1-imidazolyl, 2,4-dimethyl-1-imidazolyl, 4-methyl-1-imidazolyl, 4-nitro-1-imidazolyl, 4-chloro-1-imidazolyl, 4-phenyl-1-imidazolyl, 4-acetyl-1-imidazolyl, 4-tetradecanamide-1-imidazolyl, 1-pyrrolyl, 3,4-dichloro-1-pyrrolyl, 2-isoindolyl, 1-indolyl, 1-pyrazolyl, 1-benzimidazolyl, 5-bromo-1-benzimidazolyl, 5-octadecanamide-1-benzimidazolyl, 2-methyl-1-benzimidazolyl, 5-methyl-1-benzimidazolyl, 2-imidazolyl, 1,2,4-triazol-4-yl, 1,2,3-triazol-4-yl, 1-tetrazolyl, 4-chloro-1-pyrazolyl, 3-methyl-1-pyrazolyl, 3,5-dimethyl-1-pyrazolyl, 4-bromo-1-pyrazolyl, 4-phenyl-1-pyrazolyl, 4-methoxy-1-pyrazolyl, and 4-acetylamino-1-pyrazolyl.

Particularly preferred among them are those represented by the following formulae (IV-1) and (IV-2):

(IV-1)

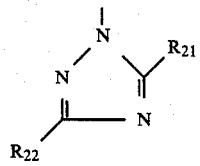

(IV-2)

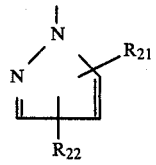

In these formulae, R21 and R22 are independently selected from hydrogen atom, halogen atom, carboxylate ester, amino, alkyl, alkylthio, alkoxy, alkylsulfonyl, alkylsulfinyl, carboxylate, sulfonate, substituted or unsubstituted phenyl, and heterocyclic groups while they may be the same or different.

General formula (V):

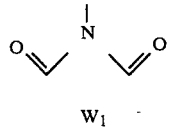

In forula (V), W1 represents a non-metallic atom or a linkage of non-metallic atoms necessary to form a four-, five- or six-membered ring with

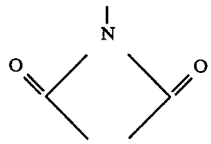

in the formula.

Particularly preferred among the groups of formula (V) are those of formulae (V-1) to (V-3) shown below.

(V-1)

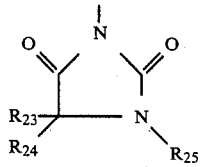

-continued (V-2)

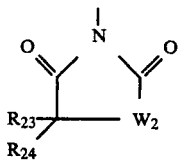

(V-3)

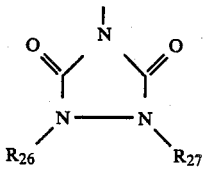

In these formulae, R23 and R24 are independently selected from hydrogen atom, alkyl, aryl, alkoxy, aryloxy, and hydroxyl groups; R25, R26, and R27 are independently selected from hydrogen atom, alkyl, aryl, aralkyl, and acyl groups; and W2 represent an oxygen of sulfur atom.

General formula (VI):

—OR2

In formula (VI), R2 represents an aryl, acyl or alkyl group which may be optionally substituted. Preferred examples of the aryl groups include phenyl, alkylsulfonylpheyl, arylsulfonylphenyl, N-alkylsulfamylphenyl, N,N-dialkylsulfamylphenyl, N-arylsulfamylphenyl, N-alkyl-N-arylsulfamylphenyl, sulfamylphenyl, nitrophenyl, acetamidephenyl, halophenyl, naphthyl, pyridyl, methoxyphenyl, hydroxyphenyl, sulfophenylazophenyl, carboxyphenyl, and sulfophenyl. The acyl group is represented by —COR28 wherein R28 is a substituted or unsubstituted alkyl group. Preferred examples of the alkyl groups represented by R28 and R2 are the same as listed for R1 in formula (III).

Among the 2-equivalent couplers are 2-equivalent yellow, magenta, and cyan couplers. Typical examples of the coupler nuclei of the 2-equivalent yellow couplers are described in U.S. Pat. Nos. 2,875,057; 2,407,210; 3,265,506; 2,298,443; 3,048,194; and 3,447,928. Preferred among these yellow couplers are acylacetamide derivatives such as benzoylacetanilide and pivaloylacetanilide. Then preferred yellow coupler residues (Cp) are those of general formulae (X) and (X) shown below.

(X)

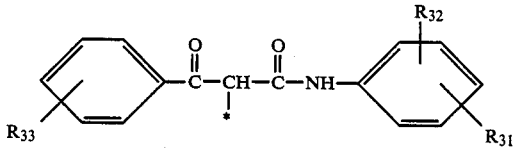

(XI)

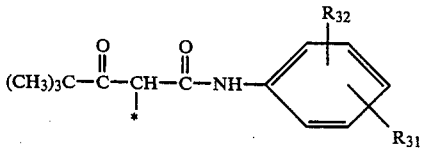

In the formulae, asterisk (*) represents the position at which the coupling-off group of the 2-equivalent yellow coupler is attached. R31 represents a nondiffusing group having 8 to 32 carbon atoms in total when the coupling-off group is free of a nondiffusing group. R31 represents a hydrogen atom, a halogen atom or halogen atoms, a substituted or unsubstituted lower alkyl group, a substituted or unsubstituted lower alkoxy group, or a nondiffusing group having 8 to 32 carbom atoms in total when the coupling-off group has a nondiffusing group attached thereto (in the case of couplers as disclosed in British Pat. No. 2,083,640). R32 and R33 each represent a hydrogen atom, a halogen atom or halogen atoms, a substituted or unsubstituted lowr alkyl group, a substituted or unsubstituted lower alkoxy group, or a nondiffusing group having 8 to 32 carbon atoms in total. When more than one R32 and R33 is present, they may be the same or different.

The preferred coupling-off groups for the 2-equivalent yellow couplers are those of general formulae (IV), (V), and (VI).

The substituent on the coupling-off group or on the coupler nucleus may be either a divalent group to form a dimer or a group connecting a high molecular weight backbone to the coupler nucleus.

Typical examples of the coupler nuclei of the 2-equivalent magenta couplers are described in U.S. Pat. Nos. 2,600,788; 2,369,489; 2,343,703; 2,311,082; 3,152,896; 3,519,429; 3,062,653; 2,908,573; and 3,733,335; and British Pat. No. 1,334,515. Preferred among these magenta couplers are pyrazolones and pyrazoloazoles including pyrazolopyrazole, pyrazloimidazole, pyrazolotriazole, and pyrazolotetrazole. The preferred magenta coupler residues (Cp) are those represented by the following formulae (XII), (XIII), and (XIV).

(XII)

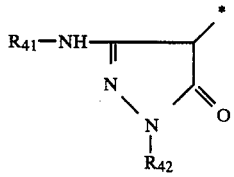

(XIII)

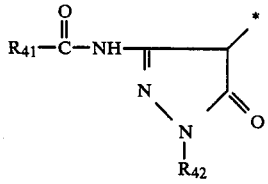

(XIV)

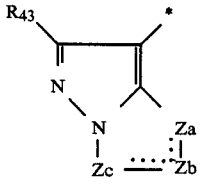

In the formulae, R41 represents a nondiffusing group having 8 to 32 carbon atoms in total when the coupling-off group is free of a nondiffusing group. R41 represents a substituted or unsubstituted lower alkyl group, a substituted or unsubstituted lower alkoxy group, a substituted or unsubstituted aryl group, or a nondiffusing group having 8 to 32 carbon atoms in total when the coupling-off group has a nondiffusing group attached thereto (in the case of couplers as disclosed in British Pat. No. 2,083,640). R42 represents a substituted or unsubstituted lower alkyl group, a substituted or unsubstituted lower alkoxy group, a substituted or unsubstituted aryl group, or a nondiffusing group having 8 to 32 carbon atoms in total. R43 will be defined later. Za, Zb, and Zc represent a methine, substituted methine, =N—, or —NH—. One of Za-Zb and Zb-Zc linkages is a double bond and the other is a single bond. The Zb-Zc linkage may be a carbon-to-carbon double bond which may be a part of an aromatic ring.

The compounds of formula (XIV) are 5-membered ring-5- membered ring fused nitrogeneous hetero couplers (to be referred to as 5,5N-heterocyclic couplers, hereinafter) whose color developing nucleus has an aromatic nature isoelectronic to naphthalene and is of a chemical structure generally designated azapentalene. Preferred among the couplers of general formula (XIV) are those of general formulae (XIV-1) to (XIV-5) shown below.

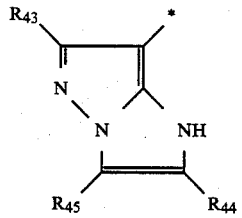
(XIV-1)

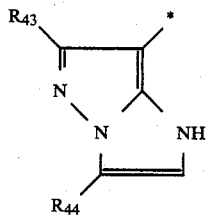
(XIV-2)

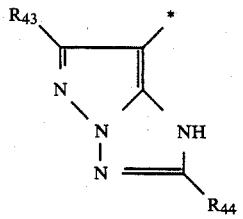
(XIV-3)

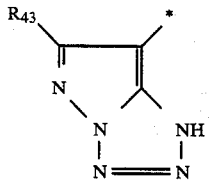
(XIV-4)

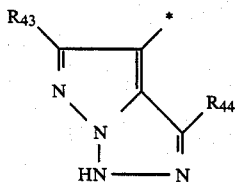
(XIV-5)

The substituents involved in the general formulae (XIV-1) to (XIV-5) are described below. R43, R44, and R45 are independently selected from hydrogen atom, halogen atom, cyano, substituted or unsubstituted alkyl, aryl, and heterocyclic groups,

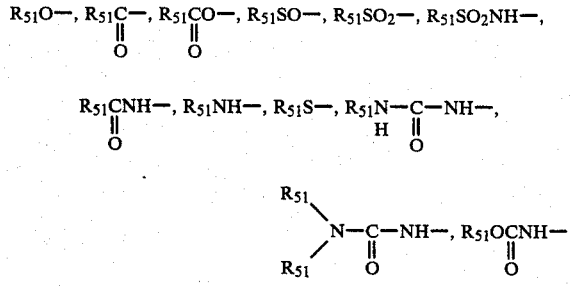

(wherein R51 is independently selected from substituted or unsubstited alkyl, aryl, and heterocyclic groups), silyl, silyloxy, silylamino, and imide groups. In addition to the above-listed groups, R43, R44, and R45 may be carbamoyl, sulfamoyl, ureido and sulfamoylamino groups wherein the nitrogen atom may have attached such a substitutent as an alkyl, aryl, alkoxy, aryloxy, halo, sulfonamide, and acylanino group.

Preferred coupling-off groups for the 2-equivalent magenta couplers are those of general formula (III), (IV), and (VI).

The substituent on the coupling-off group or on the coupler nucleus may be either a divalent group to form a dimer or a group connecting a high molecular weight backbone to the coupler nucleus.

Typical examples of the coupler nuclei of the 2-equivalent cyan couplers are described in U.S. Pat. Nos. 2,772,162; 2,895,826; 3,002,836; 3,034,892; 2,474,293; 2,423,730; 2,367,531; and 3,041,236. Preferred among these cyan couplers are phenols and naphthols. The preferred cyan coupler residues (Cp) are those of general formulae (XV), (XVI), (XVII), and (XVIII) shown below.

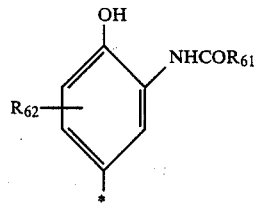
(XV)

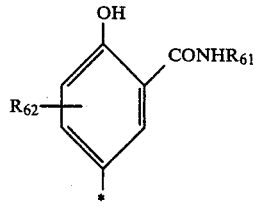
(XVI)

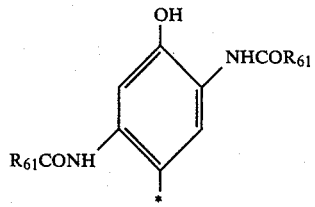
(XVII)

-continued (XVIII)

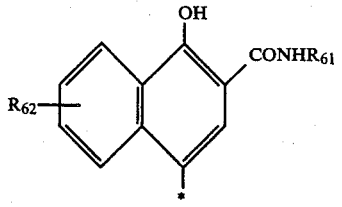

In the formulae, asterisk (*) represents the position at which the coupling-off group of the 2-equivalent cyan coupler is attached. R61 represents a nondiffusing group having 8 to 32 carbon atoms in total when the coupling-off group is free of a nondiffusing group. R61 represents a hydrogen atom, a substituted or unsubstituted lower alkyl group, a substituted or unsubstituted lower alkoxy group, an aryl group, or a nondiffusing group having 8 to 32 carbon atoms in total when the coupling-off group has a nondiffusing group attached thereto (in the case of couplers as disclosed in British Pat. No. 2,083,640). R62 represents a hydrogen atom, a halogen atom or halogen atoms, a substituted or unsubstituted lower alkyl group, a substituted or unsubstituted lower alkoxy group, or a nondiffusing group having 8 to 32 carbon atoms in total. When more than one R62 is present, they may be the same or different.

The preferred coupling-off groups for the 2-equivalent cyan couplers are those of general formulae (III), (IV), and (VI).

The substituent on the coupling-off group or on the coupler nucleus may be either a divalent group to form a dimer or a group connecting a high molecular weight backbone to the coupler nucleus.

In the foregoing couplers, the nondiffusing groups may be those illustrated in the following patent publications.

| | | |
|---|---|---|
| Japanese Patent Application Kokai Nos. | | |
| 47-4481 | 47-37636 | 48-71640 |
| 49-8228 | 49-29639 | 49-53437 |
| 49-110344 | 50-19435 | 50-20723 |
| 50-48922 | 50-134644 | 51-126831 |
| 52-47728 | 52-119323 | 53-76834 |
| 53-82411 | 53-141622 | 55-7702 |
| 55-38599 | 55-93153 | 56-30126 |
| 59-45442 | 59-124341 | 59-174836 |
| 59-177553 | 59-177554 | 59-177555 |
| 59-177556 | 59-177557 | 60-41042 |
| 60-55340 | 60-185951 | |
| Japanese Patent Publication Nos. | | |
| 42-23902 | 43-16190 | 43-22900 |
| 43-29417 | 44-3660 | 44-6992 |
| 45-41474 | 46-19025 | 46-19026 |
| 46-19032 | 47-9314 | 48-25932 |
| 49-16056 | 59-46384 | |
| U.S. Pat. Nos. | | |
| 2,186,719 | 2,688,544 | 2,698,795 |
| 2,772,161 | 2,895,826 | 2,908,573 |
| 2,920,961 | 3,133,815 | 3,161,512 |
| 3,183,095 | 3,285,747 | 3,488,193 |
| 3,519,429 | 3,547,944 | 4,124,396 |
| 4,443,536 | 4,458,011 | |

German Offenlegungsschrift No. 2,707,488
French Patent No. 1,202,940
British Patent No. 1,128,037

Examples of the 2-equivalent couplers are illustrated below.

Two equivalent yellow couplers

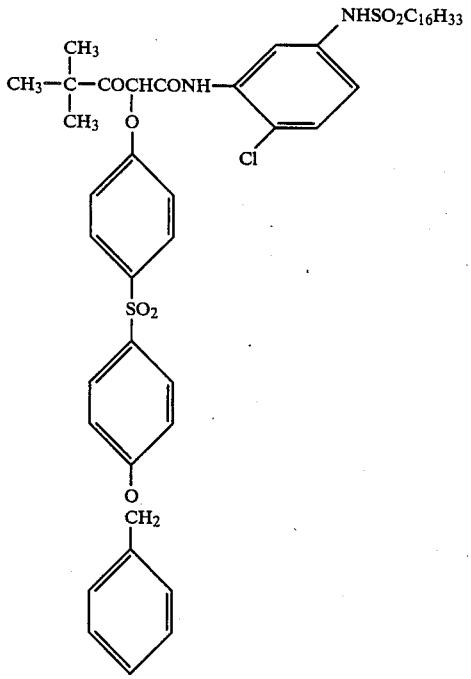

Y-1

-continued
Y-2
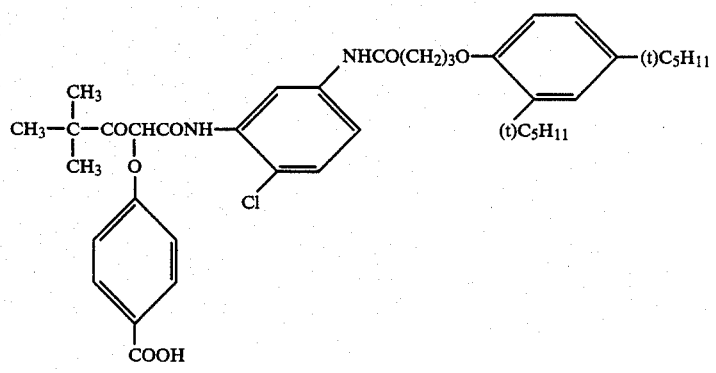
Y-3
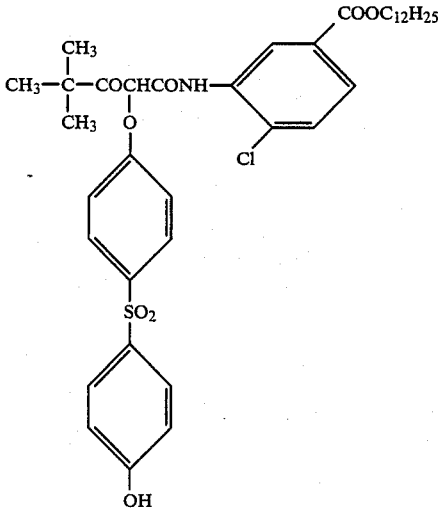
Y-4
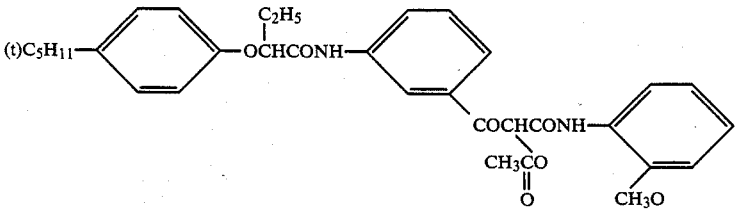
Y-5
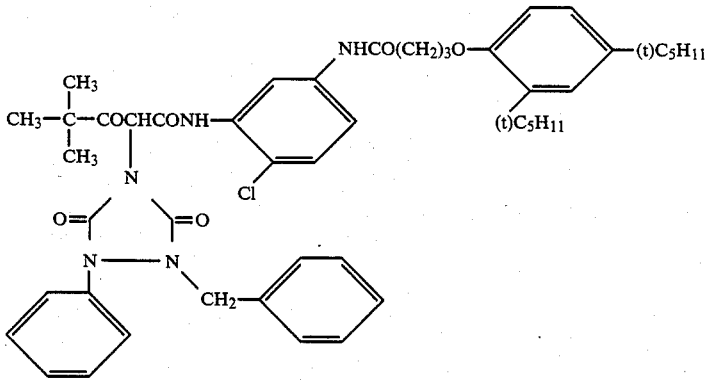

-continued
Y-6
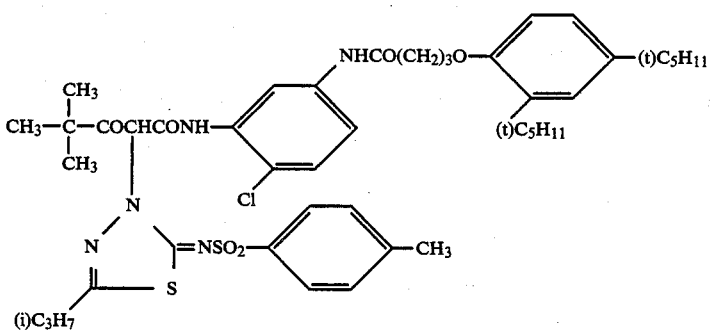
Y-7
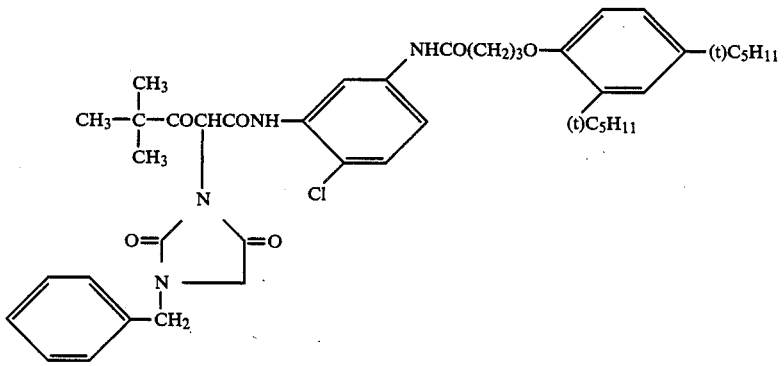
Y-8
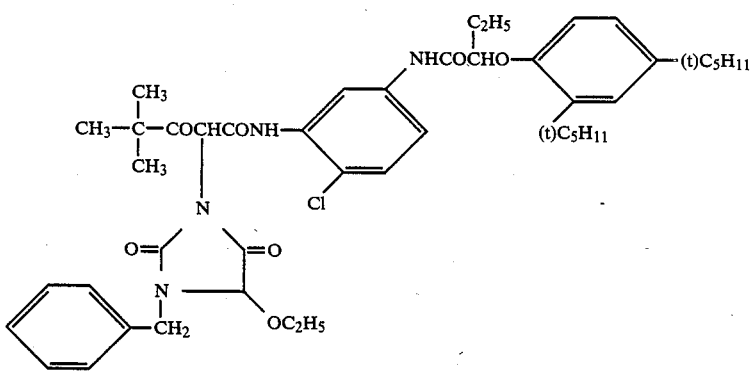
Y-9
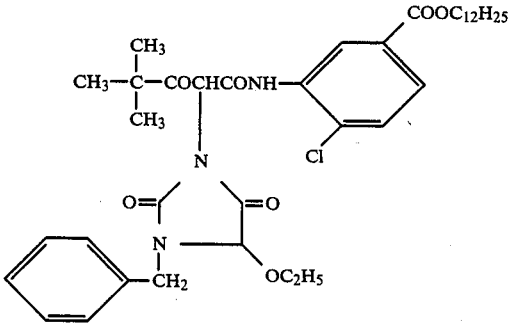

-continued
Y-10
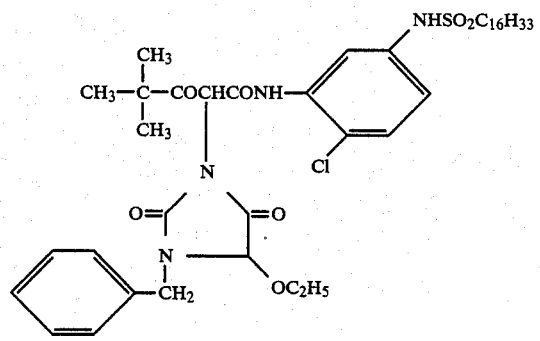
Y-11
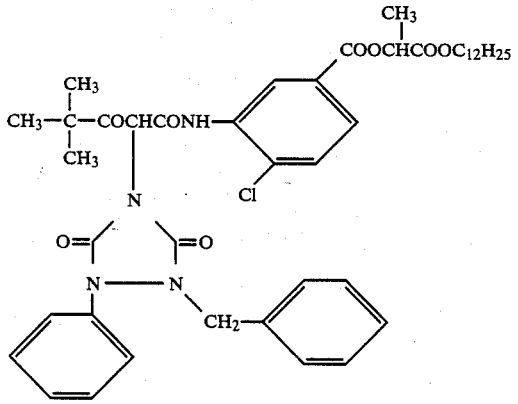
Y-12
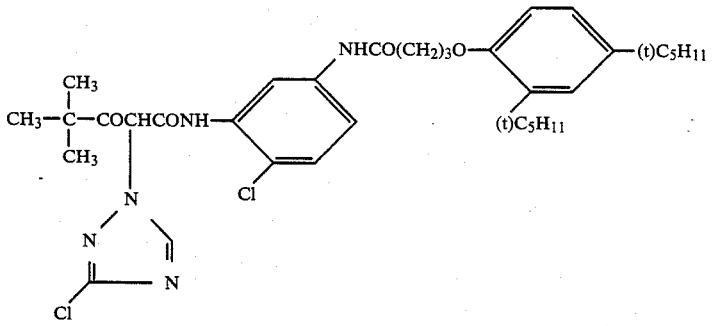
Y-13
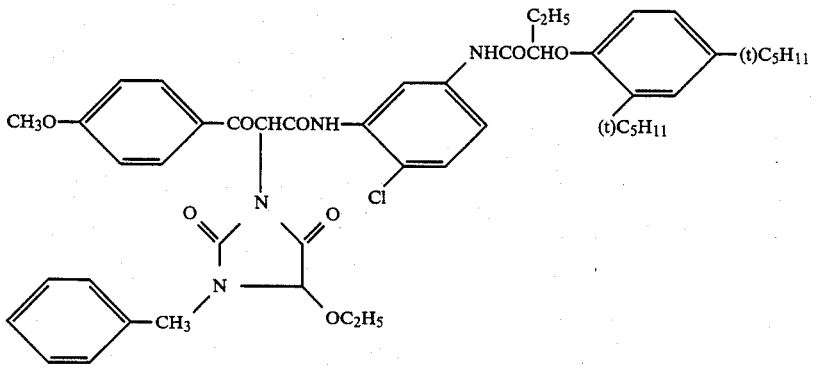

-continued
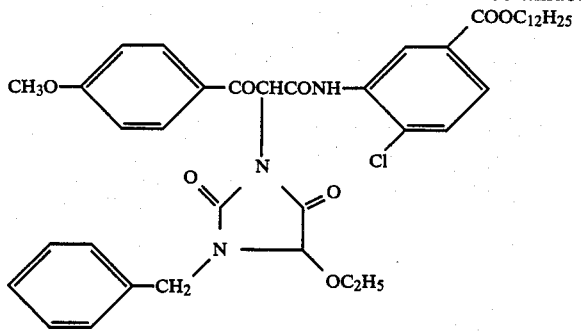
Y-14
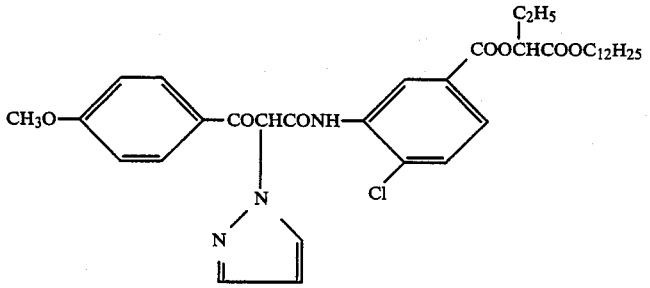
Y-15
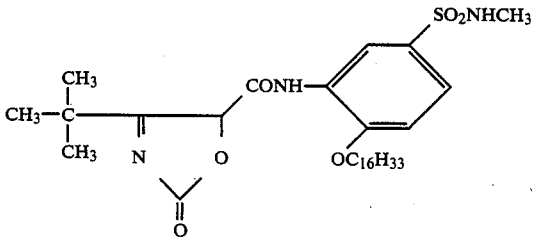
Y-16
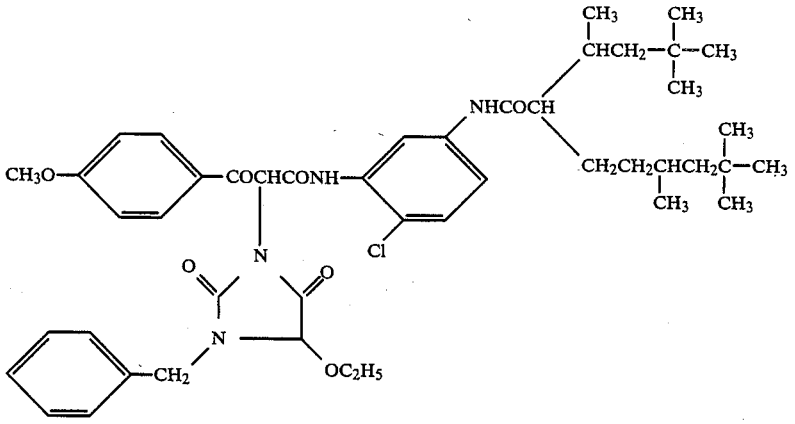
Y-17
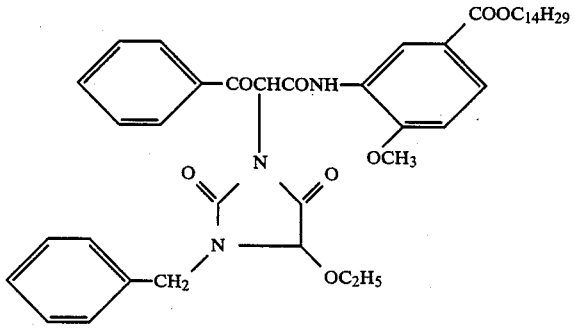
Y-18

-continued
Y-19
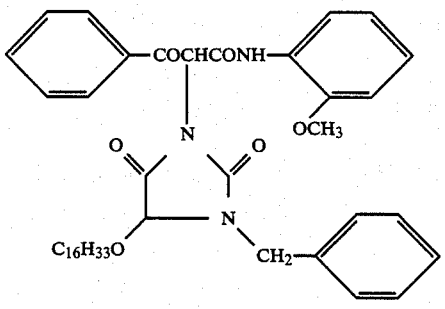
Y-20
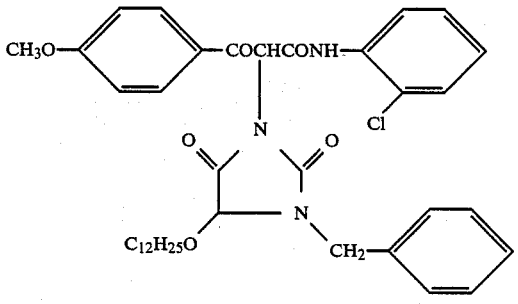
Y-21
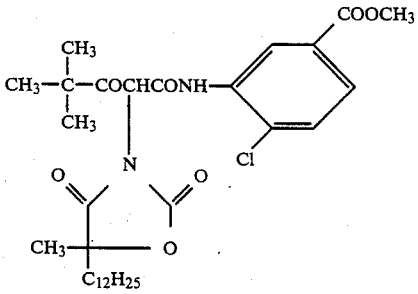
Y-22
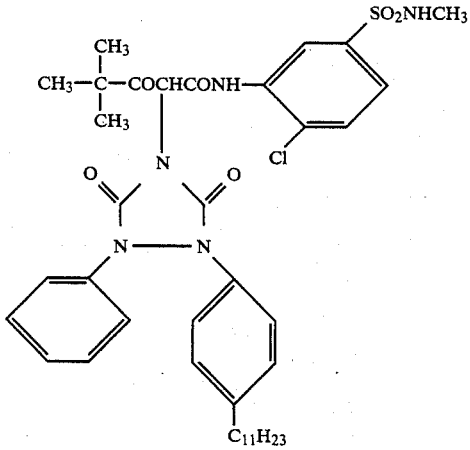

-continued
Y-23
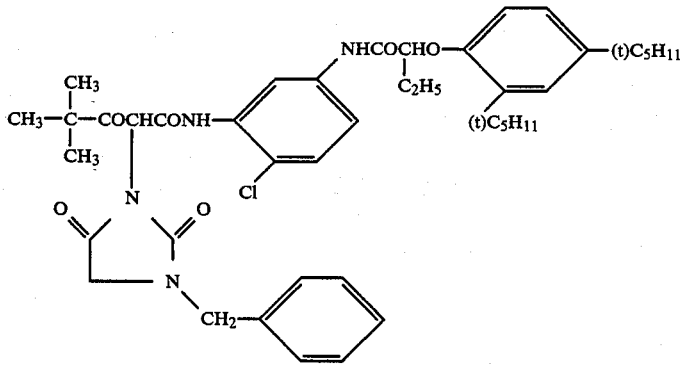
Y-24
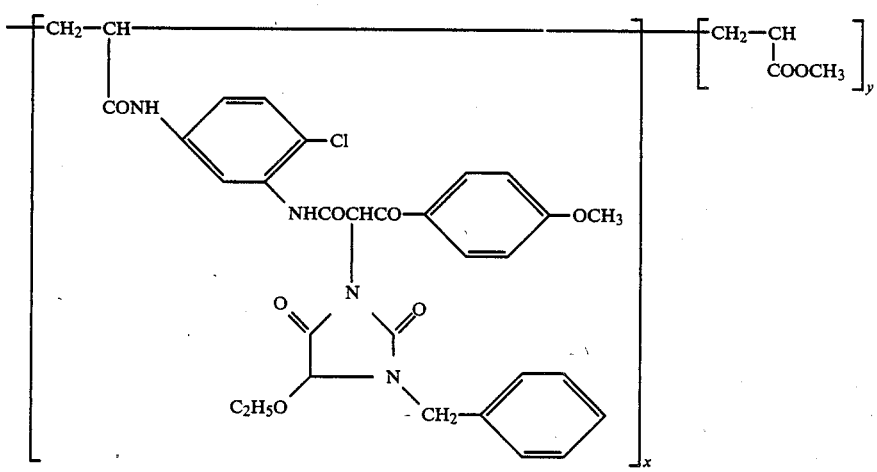
x:y = 30:70
Y-25
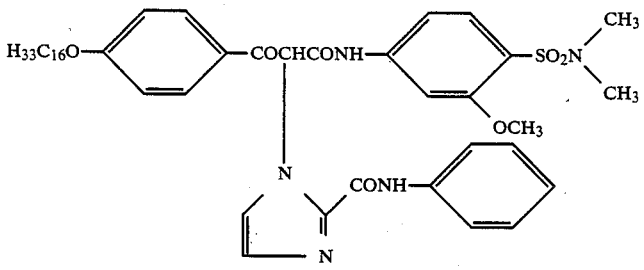
Y-26
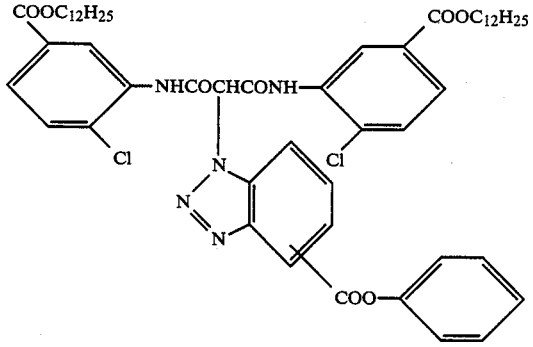

-continued
Y-27
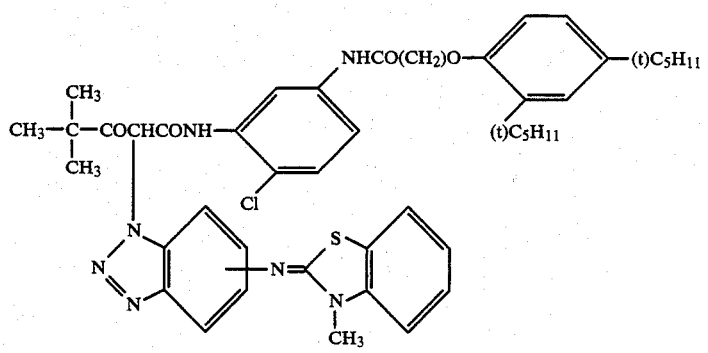
Y-28
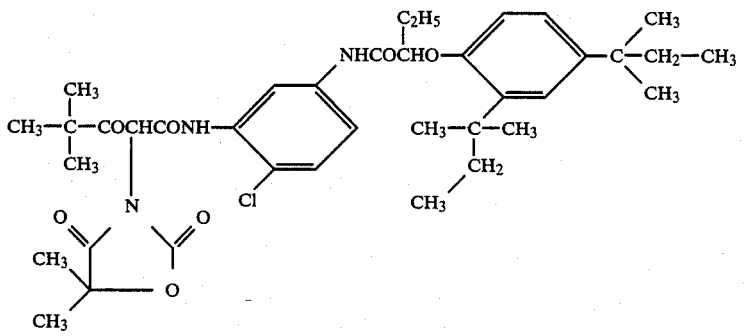
Two equivalent magenta couplers
M-1
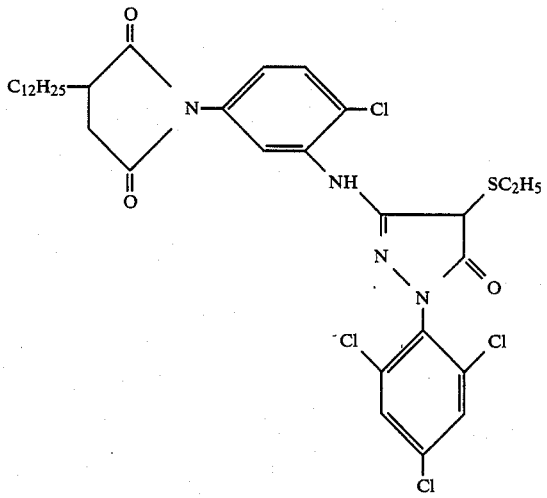
M-2
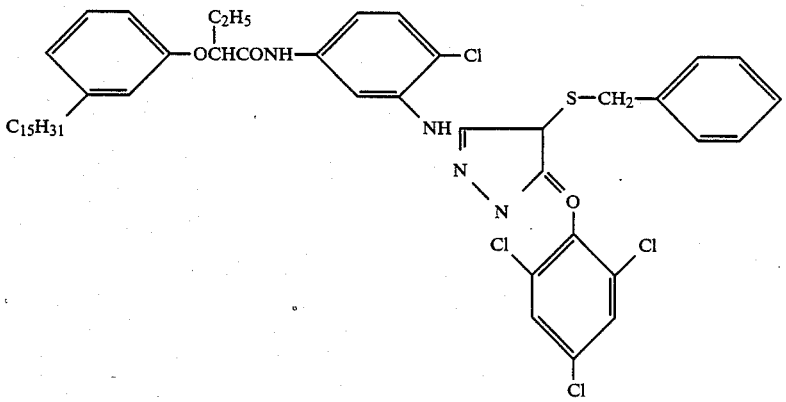

-continued
M-3
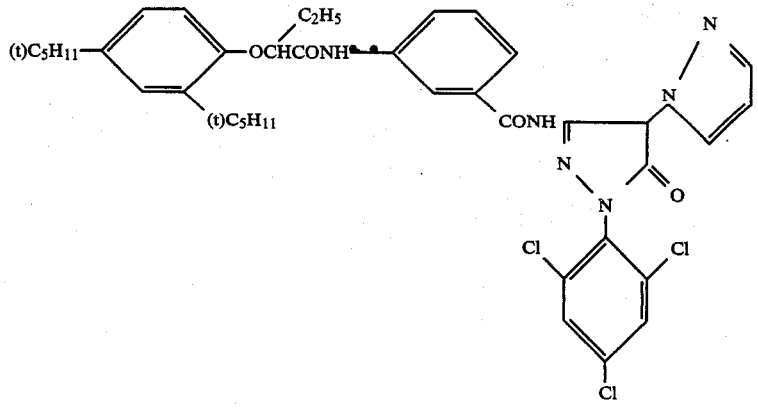
M-4
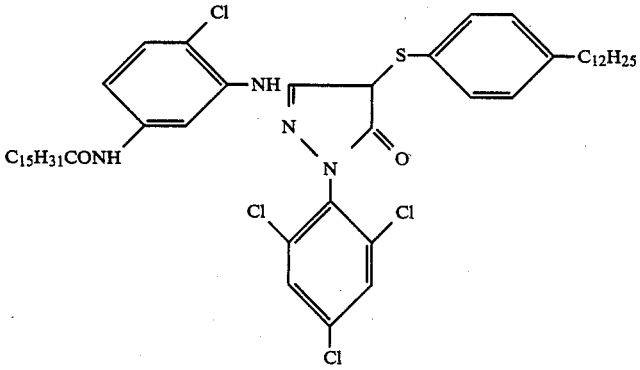
M-5
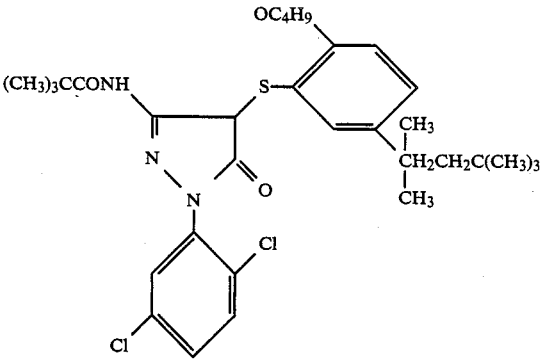
M-6
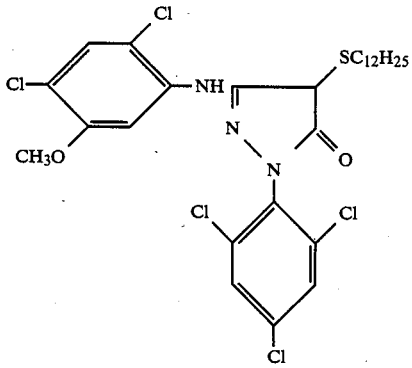

-continued
M-7
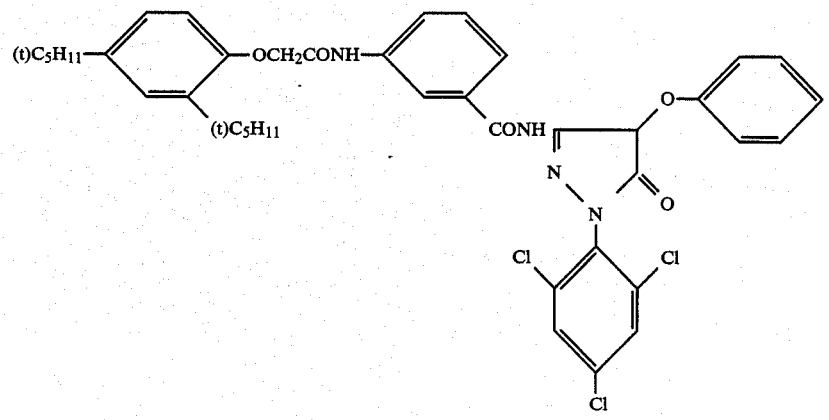
M-8
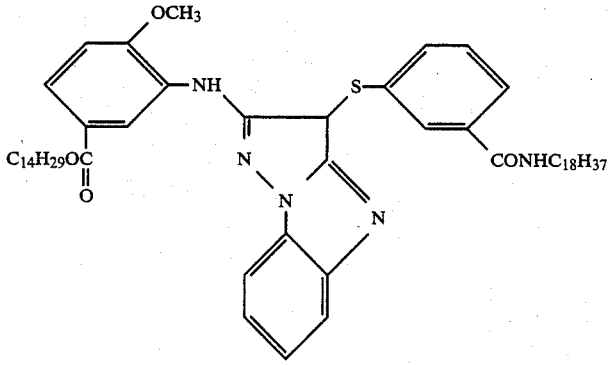
M-9
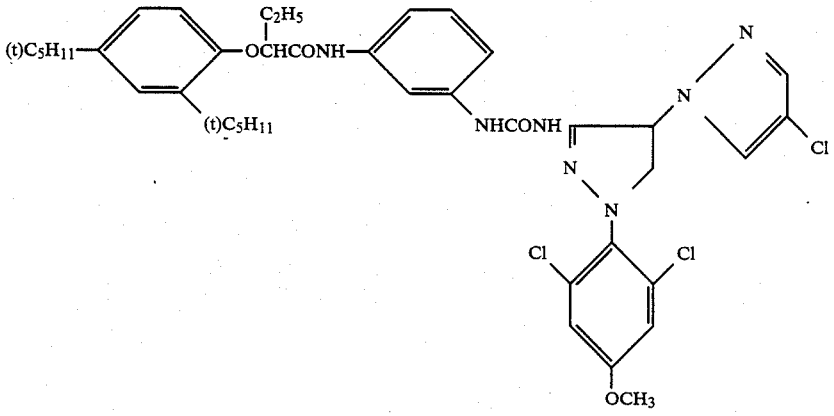
M-10
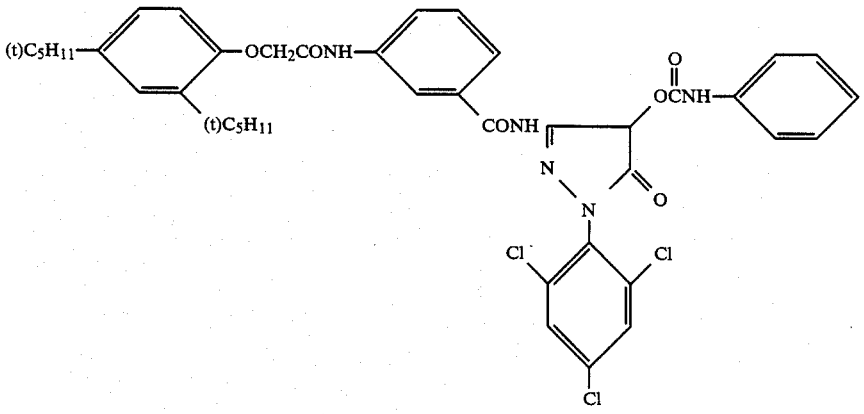

-continued
M-11
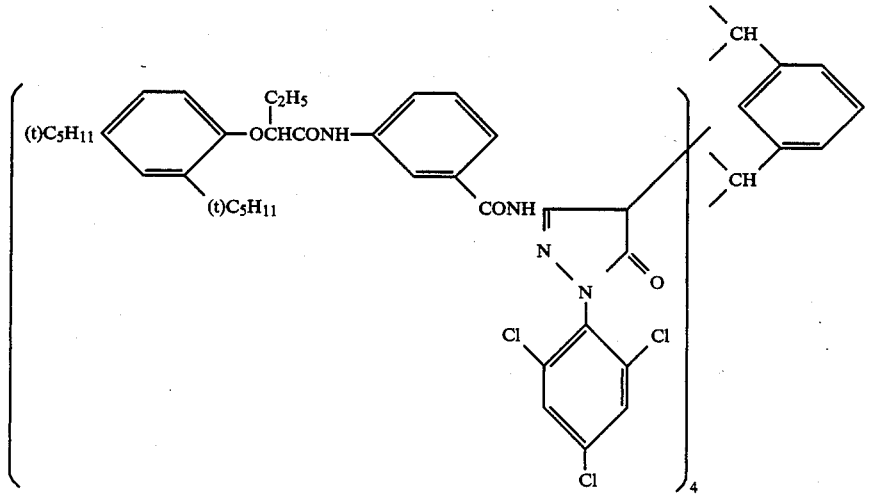
M-12
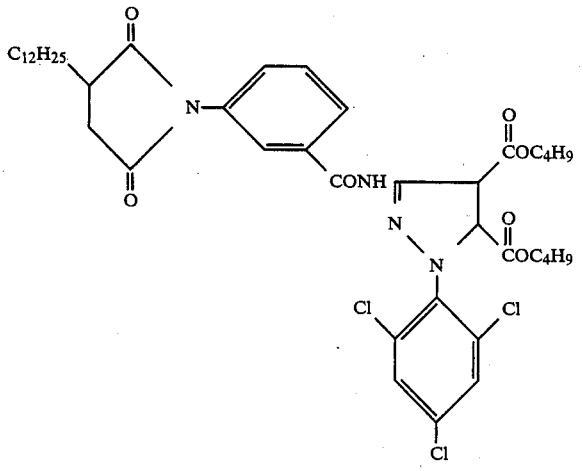
M-13
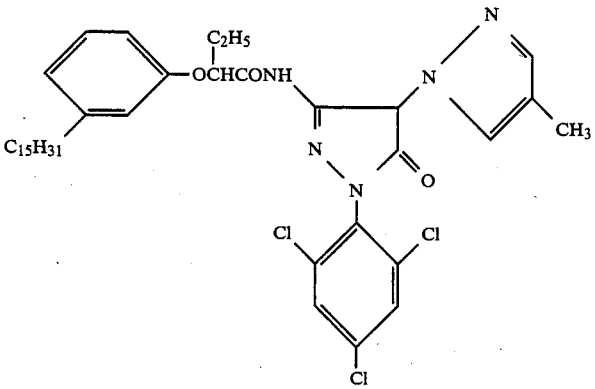

-continued
M-14
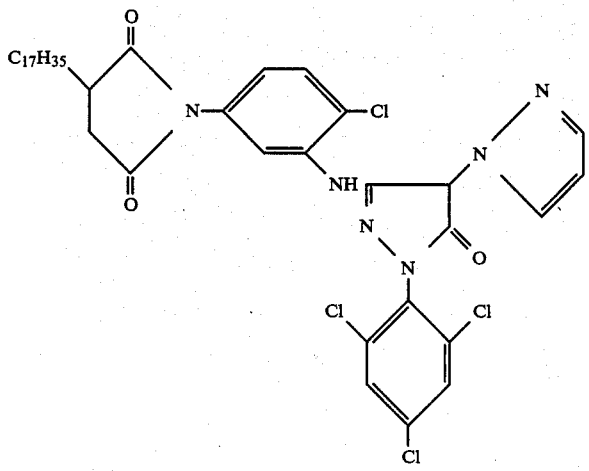
M-15
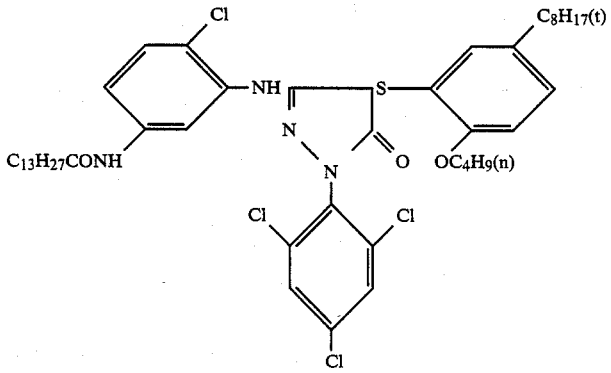
M-16
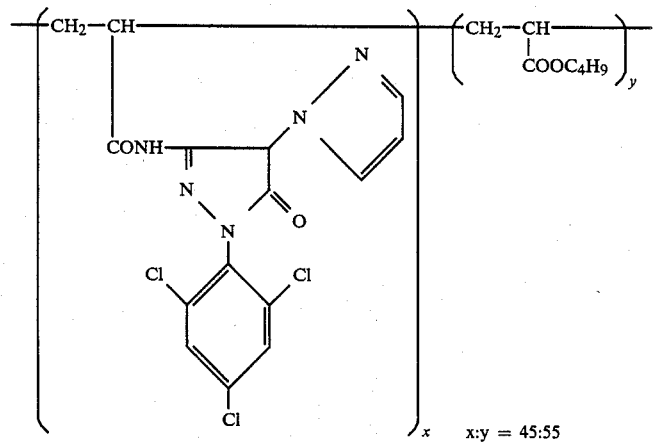
x:y = 45:55

-continued
M-17
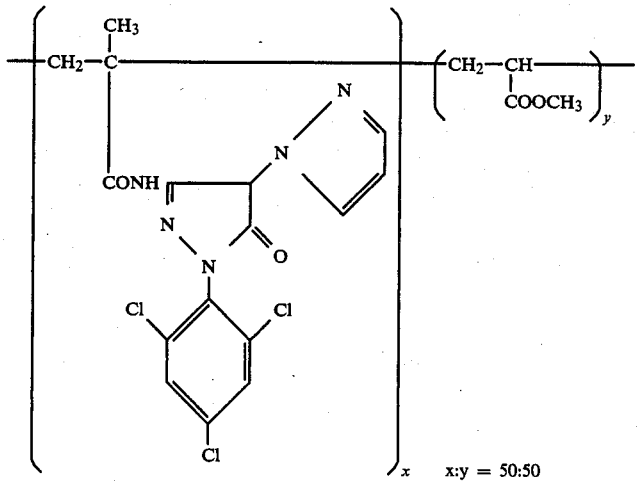
M-18
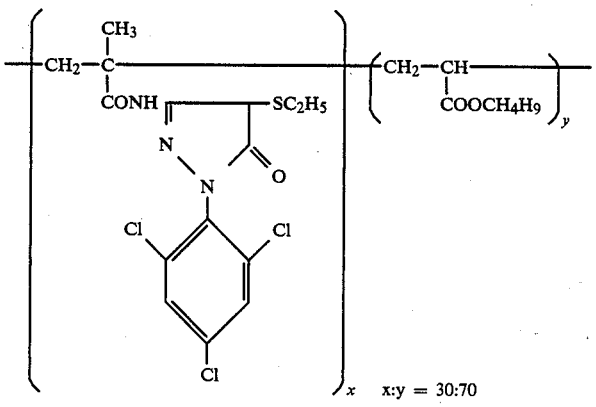
M-19
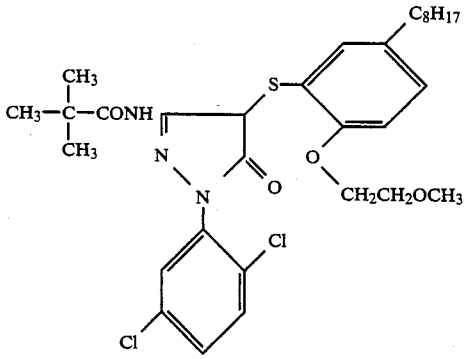
M-20
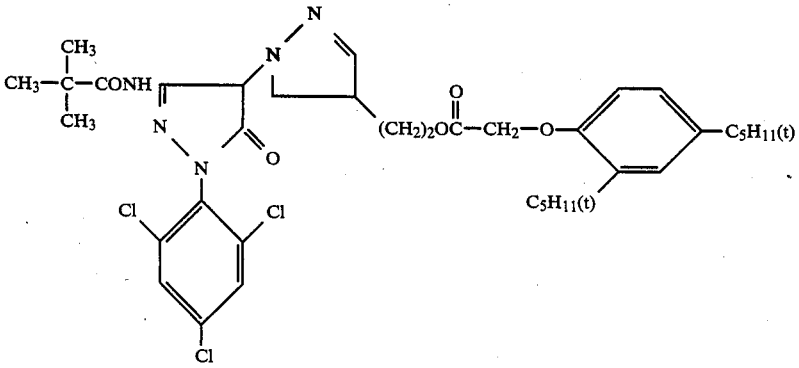

-continued
M-21
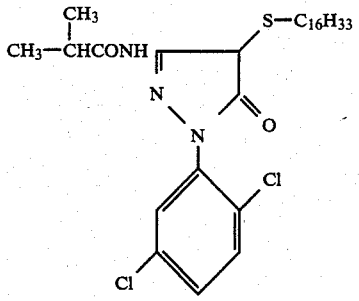
M-22
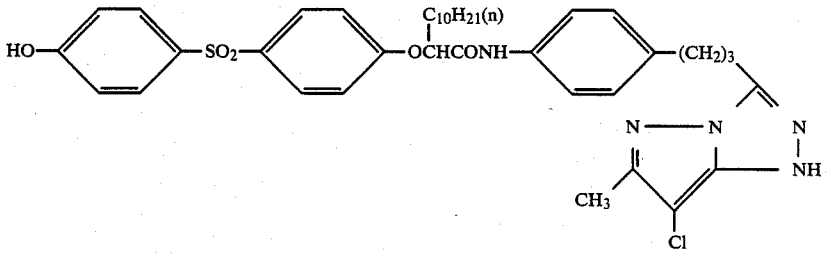
M-23
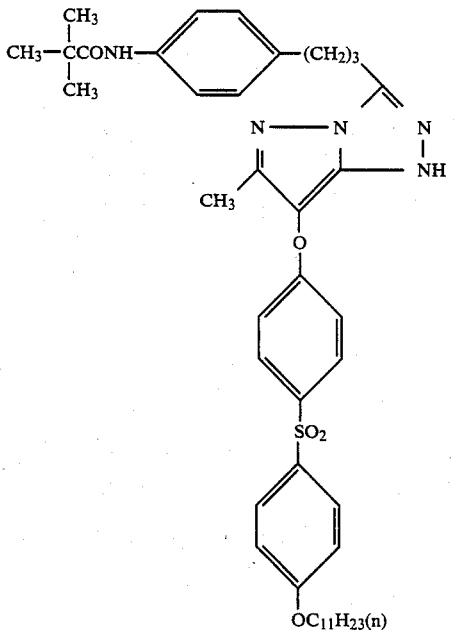
M-24
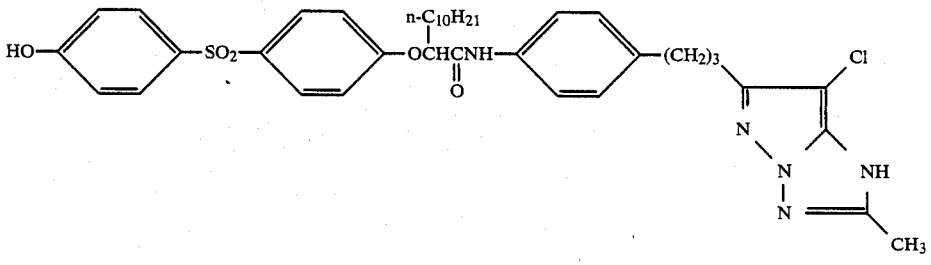

-continued
M-25
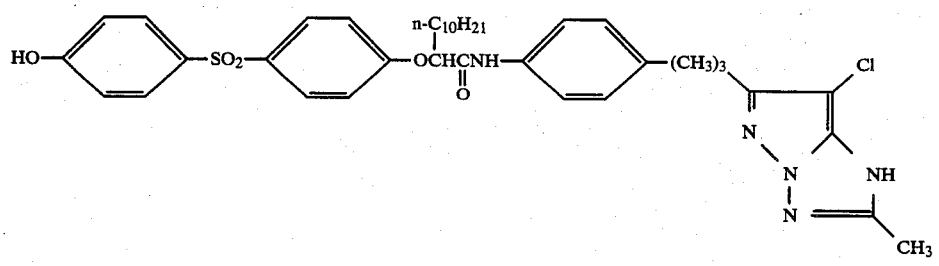
M-26
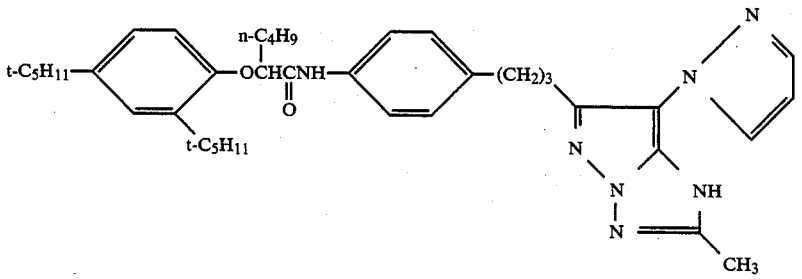
M-27
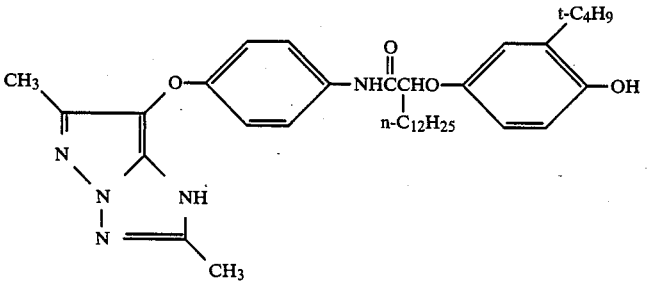
M-28
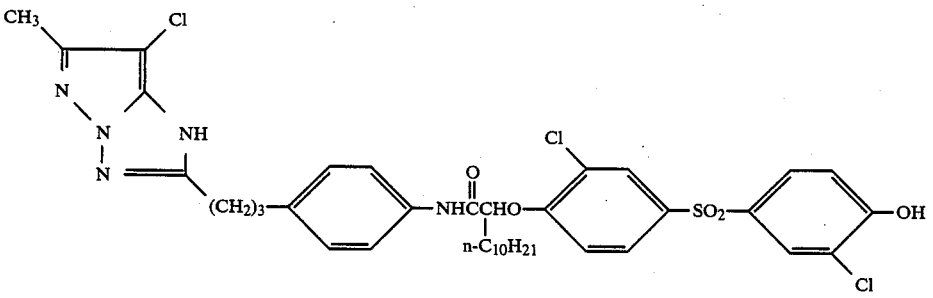
M-29
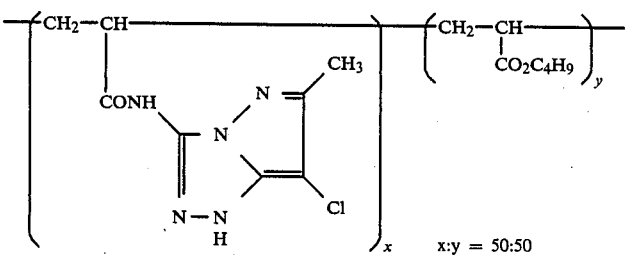
x:y = 50:50

-continued
M-30
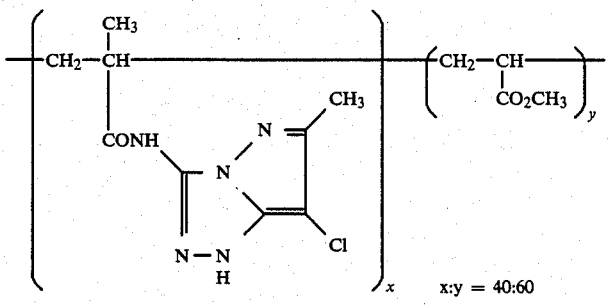
M-31
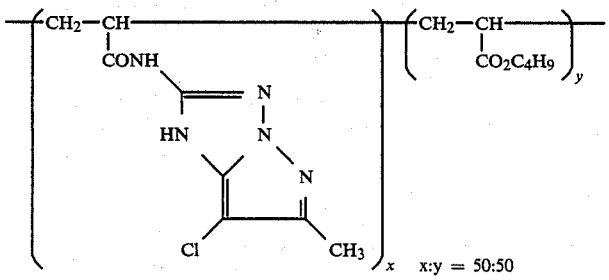
M-32
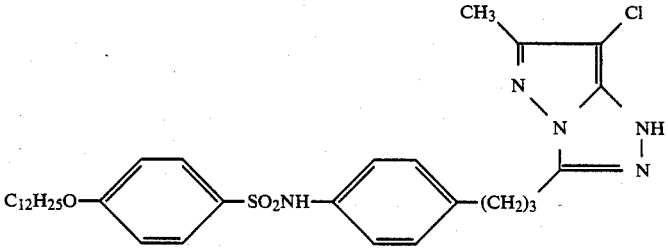
M-33
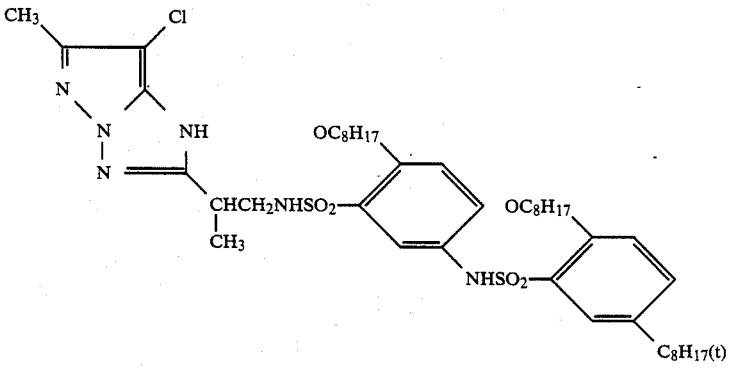
M-34
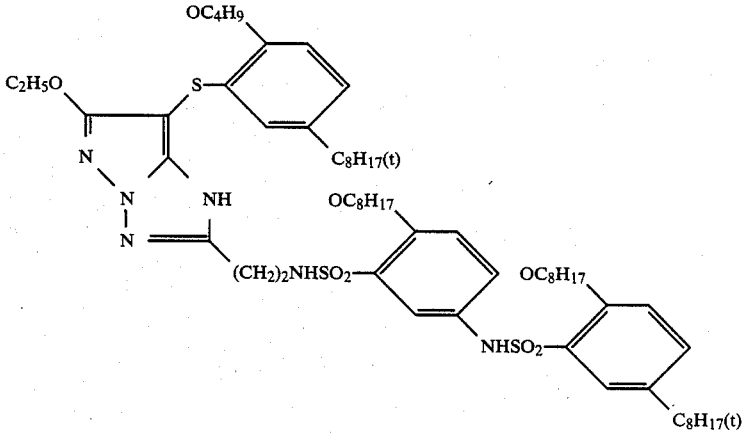

-continued
M-35
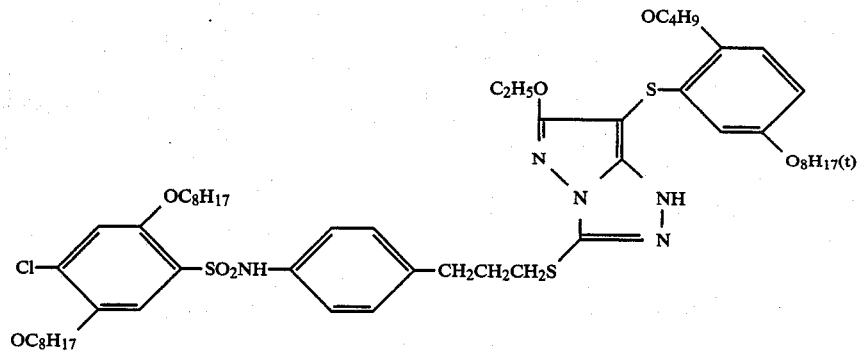
M-36
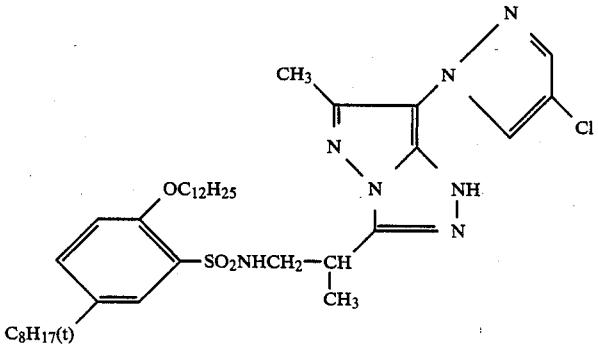
M-37
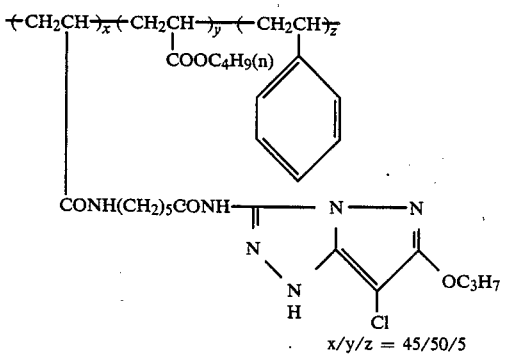
x/y/z = 45/50/5
M-38
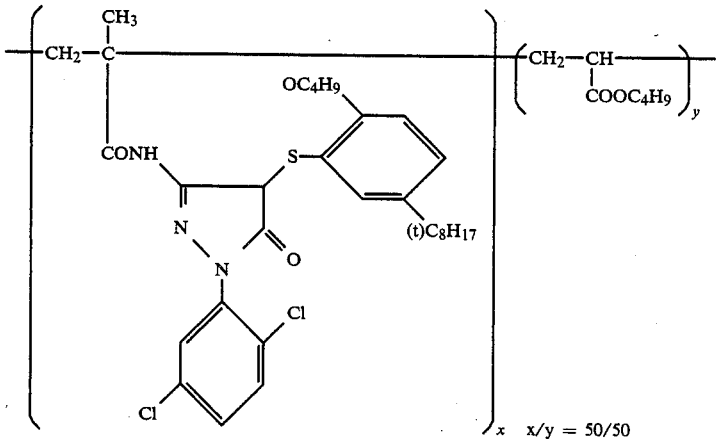
x/y = 50/50

-continued
M-39
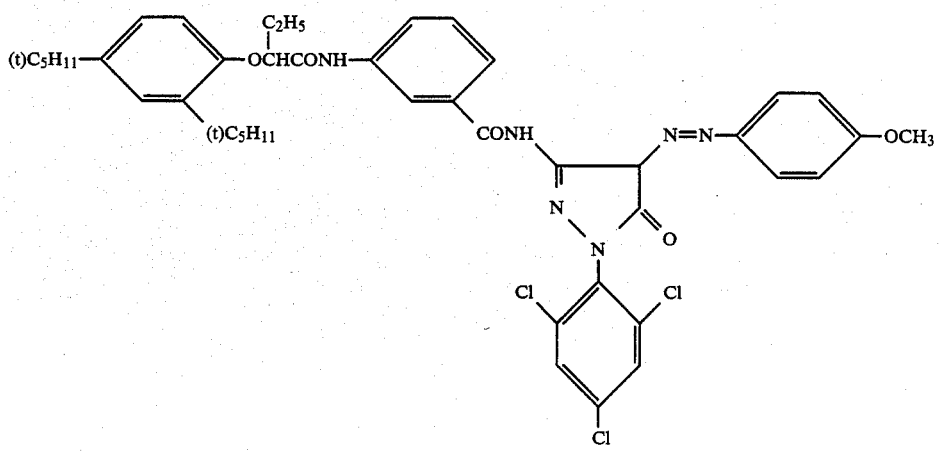
M-40
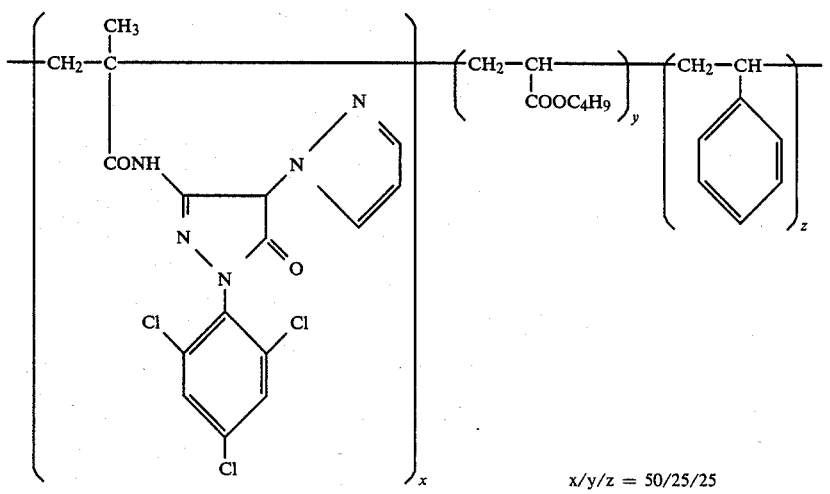
x/y/z = 50/25/25
M-41
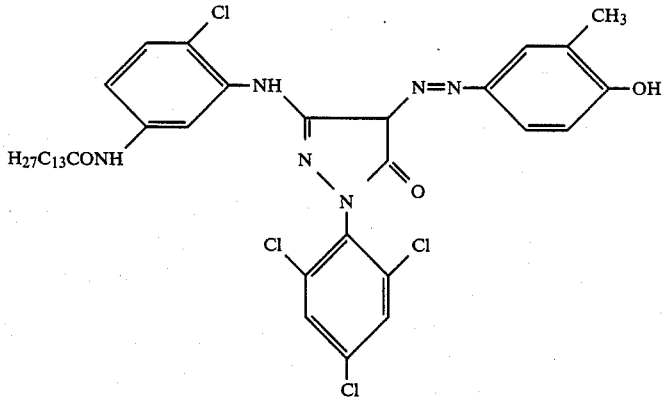
Two equivalent cyan couplers
C-1
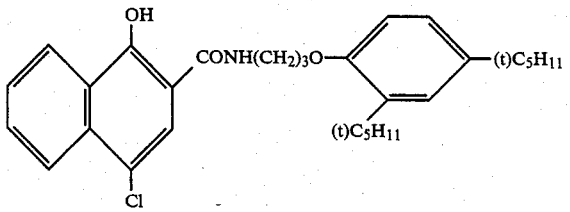

-continued
C-2
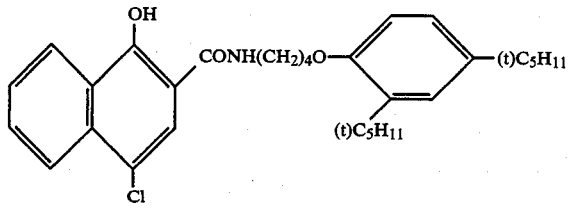
C-3
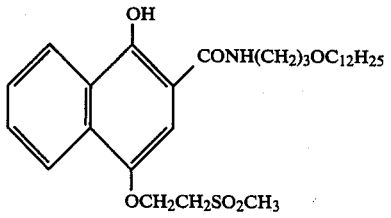
C-4
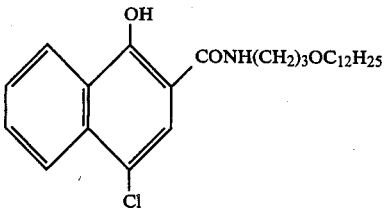
C-5
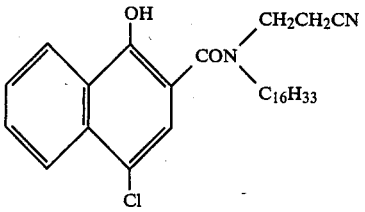
C-6
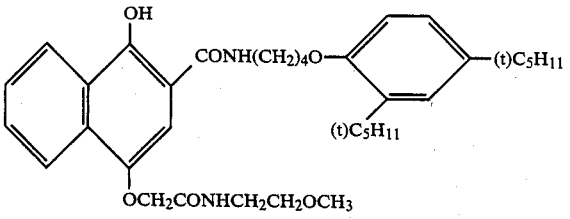
C-7
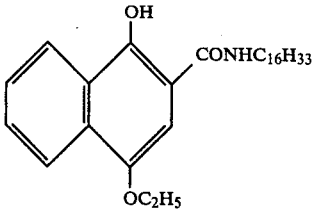
C-8
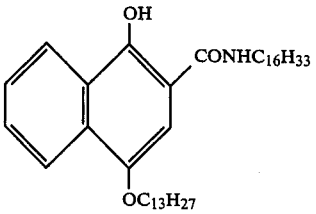

-continued
C-9
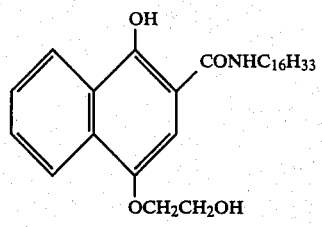
C-10
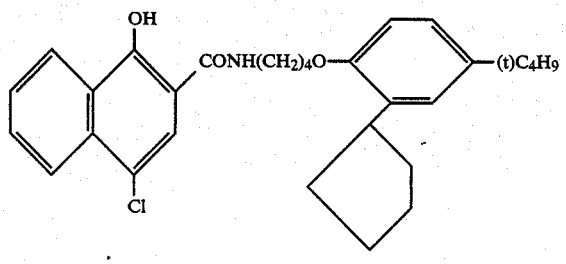
C-11
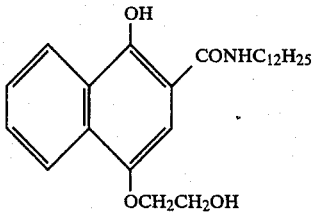
C-12
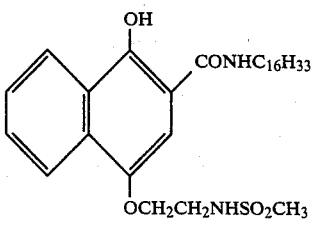
C-13
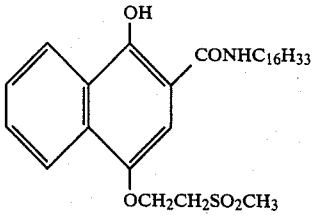
C-14
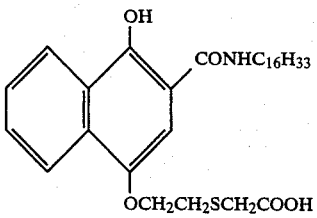
C-15
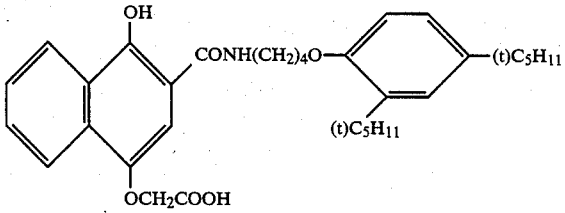

-continued
C-16
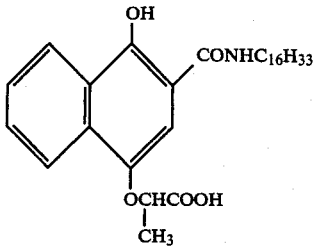
C-17
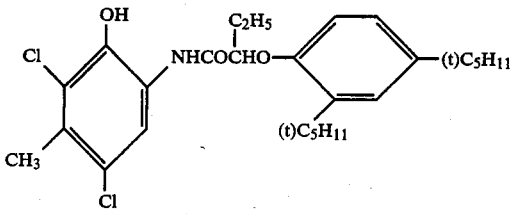
C-18
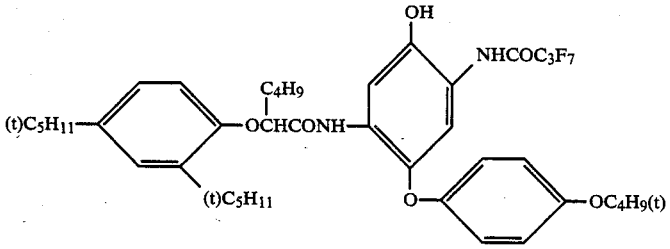
C-19
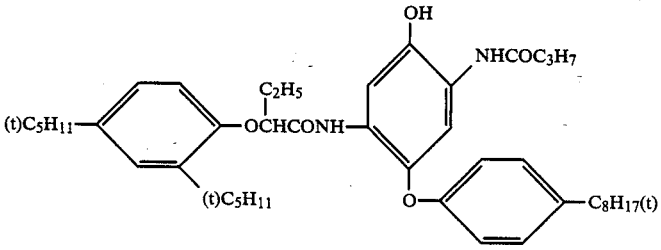
C-20
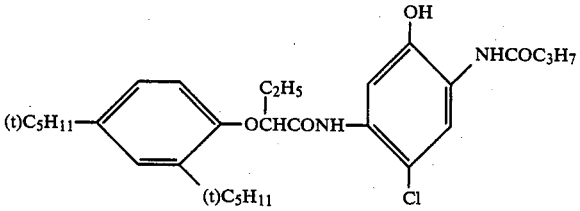
C-21
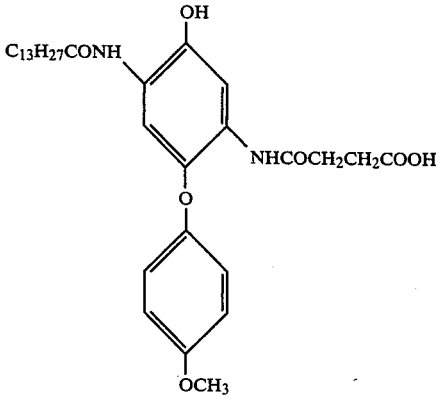

-continued
C-22
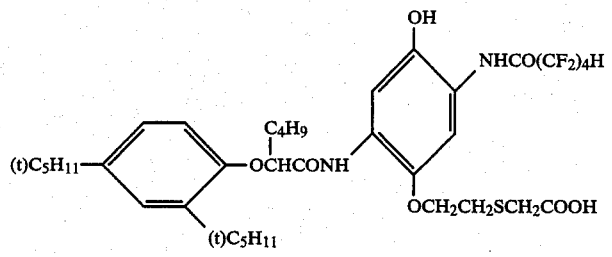
C-23
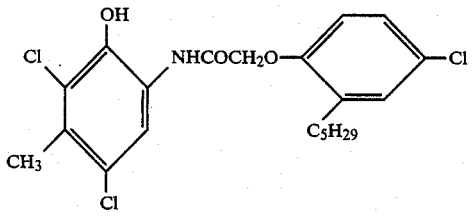
C-24
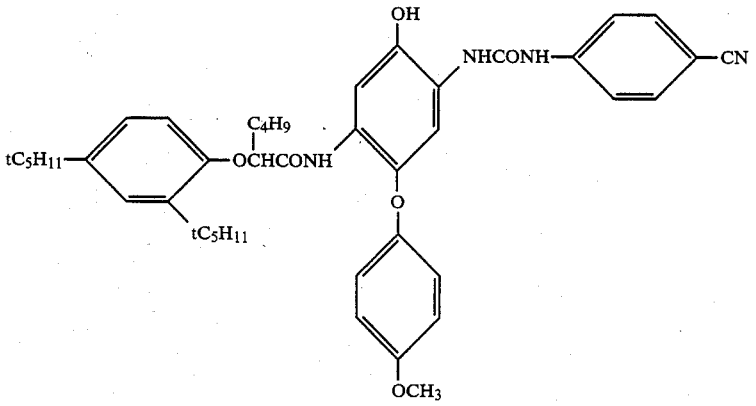
C-25
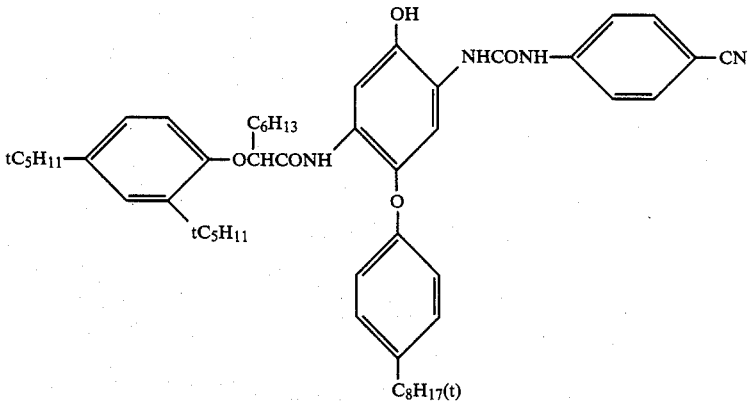

-continued
C-26
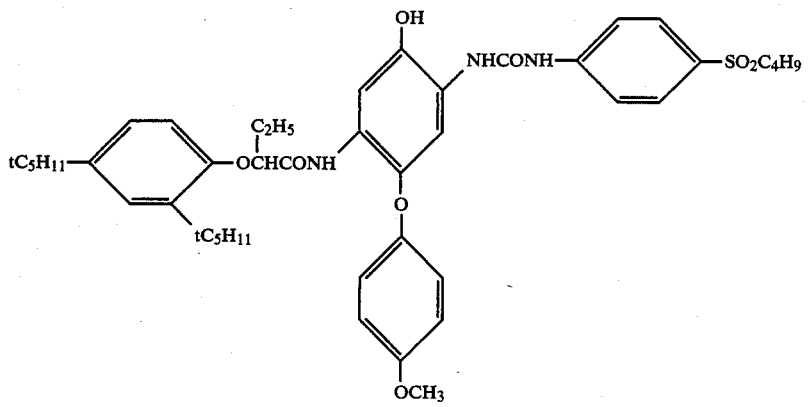
C-27
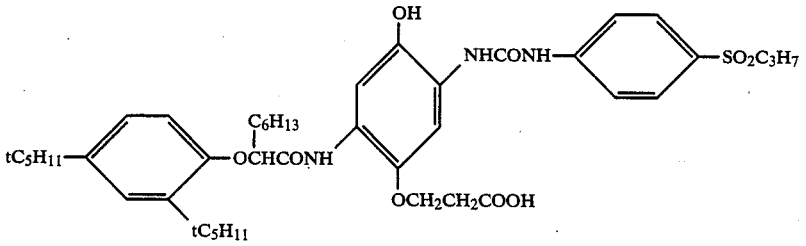
C-28
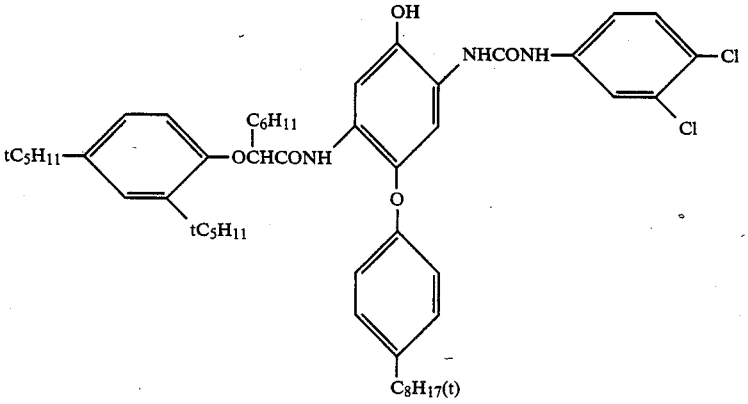
C-29
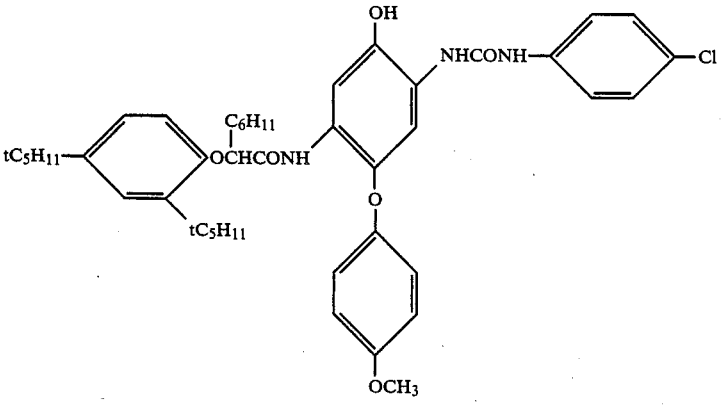

-continued
C-30
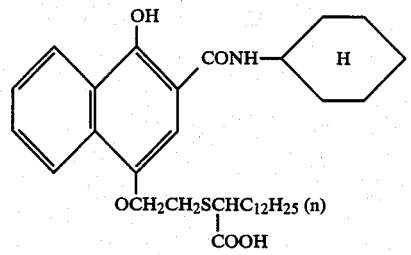
C-31
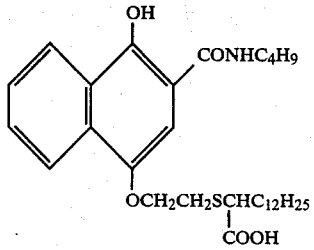
C-32
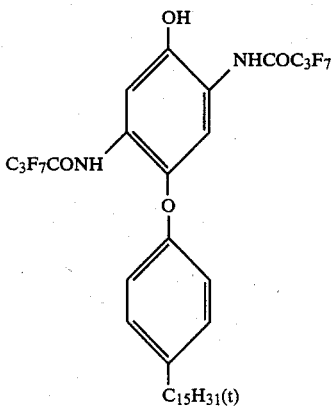
C-33
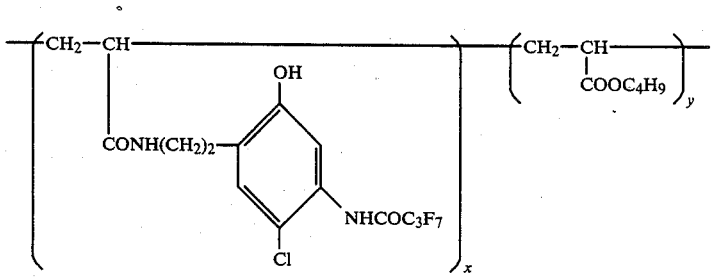
x:y = 40:60
C-34
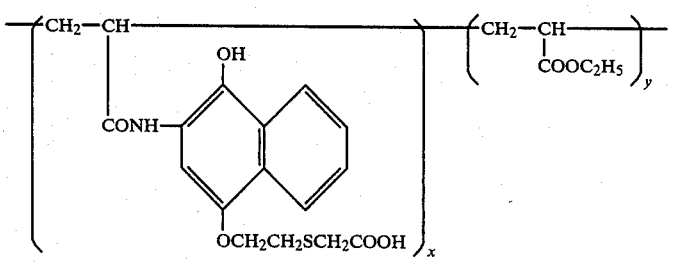
x:y = 45:55

-continued
C-35
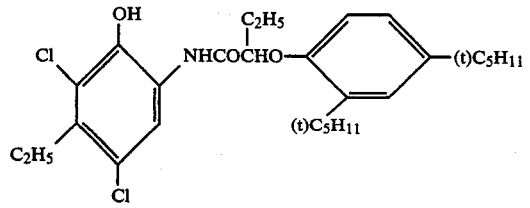
C-36
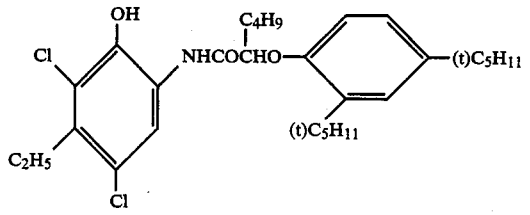
C-37
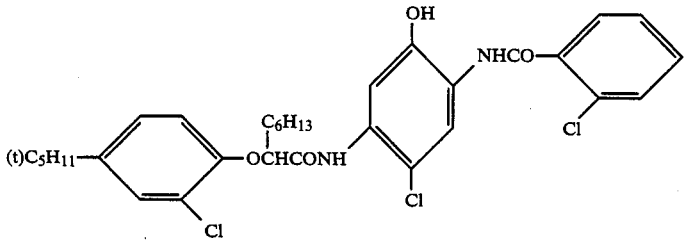
C-38
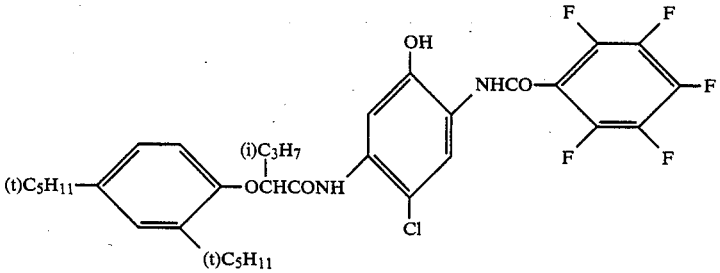
C-39
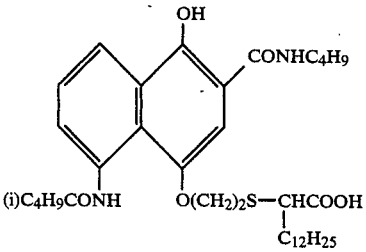
C-40
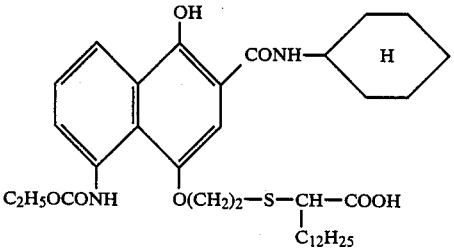

-continued

C-41

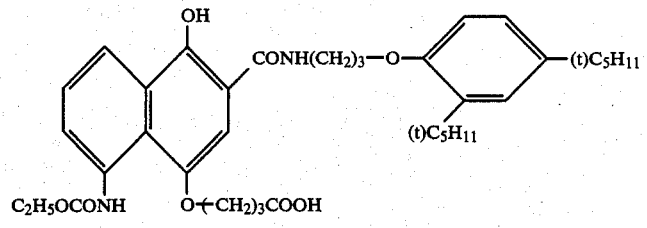

C-42

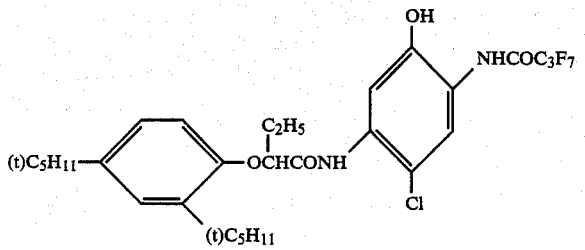

C-43

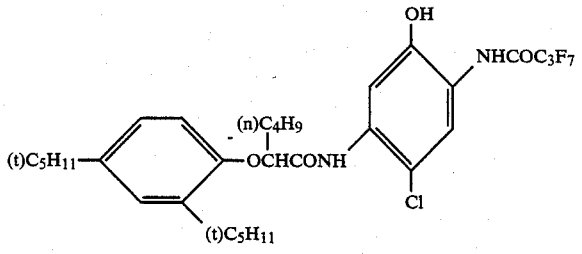

C-44

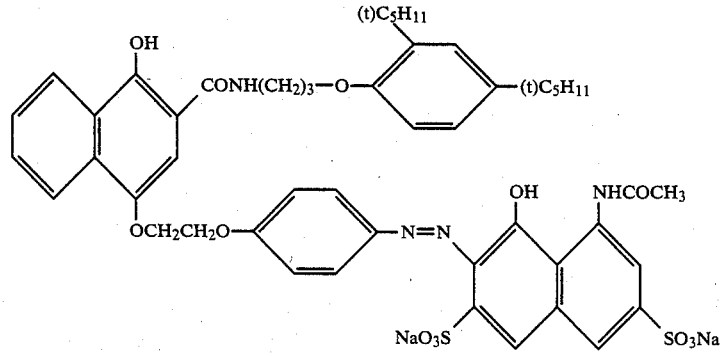

C-45

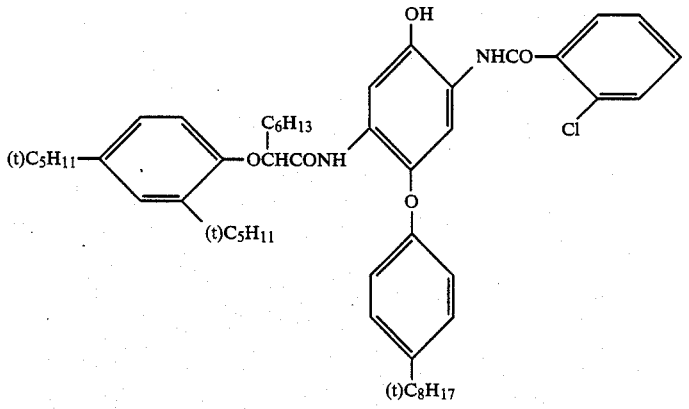

The couplers may be introduced into silver halide emulsion layers by any well-known methods, for example, as described in U.S. Pat. No. 2,322,027. The couplers are first dissolved in a suitable solvent, for example, alkyl phthalates such as dibutyl phthalate and dioctyl phthalate; phosphates such as diphenyl phosphate, triphenyl phosphate, tricresyl phosphate, and dioctyl butyl phosphate; citrates such as tributyl acetylcitrate; benzoates such as octyl benzoate; alkyl amides such as diethyl laurylamide; fatty acid esters such as dibutoxyethyl succinate and diethyl azelate; trimesates such as tributyl trimesate; and organic solvents having a boiling point of from about 30° C. to 150° C., for example, lower alkyl acetates such as ethyl acetate and butyl acetate; ethyl propionate, sec. butyl alcohol, methyl isobutyl ketone, β-ethoxyethyl acetate, methyl cellosolve acetate, etc. before they are dispersed in hydrophilic colloid. A mixture of high- and low-boiling organic solvents as described above may be used. It is also possible to disperse the couplers in polymers as described in Japanese Patent Publication No. 51-39853 and Japanese Patent Publication Kokai No. 51-59943. The couplers in aqueous alkaline solution are introduced into hydrophilic colloid when they have an acid group such as carboxylate and sulfonate groups.

To impart desired development properties, image properties, and film physical properties, various additives are sometimes preferably added to the photosensitive material. Included in these additives are iodides in salt form such as alkali metal iodides and organic compounds having a free mercapto group, such as phenyl mercaptotetrazole. Using a large amounts of these additives should desirably be avoided.

To increase sensitivity, enhance contrast or accelerate development, the photosensitive material may contain, for example, polyalkylene oxides or their ether, ester, and amine derivatives, thioethers, thiomorpholines, quaternary ammonium salts, urethane derivatives, urea derivatives, imidazole derivatives, and 3-pyrazolidones. Useful compounds are disclosed in U.S. Pat. Nos. 2,400,532, 2,423,549, 2,716,062, 3,617,280, 3,772,021, and 3,808,003 and British Pat. No. 1,488,991.

The photosensitive material may have an antifoggant added to a photosensitive silver halide emulsion layer or photo-sensitive auxiliary layer thereof. Preferred examples of the antifoggants are heterocyclic organic compounds such as tetrazoles, azaindenes, triazoles, aminopurines.

Other additives which may be added to the photosensitive material are hardeners, plasticizers, lubricants, surface agents, gloss agents and other additives well known in the photographic art.

A binder or protective colloid used in the photographic emulsion is advantageously gelatin although hydrophilic colloids may be used. Examples include proteins such as gelatin, gelatin derivatives, graft polymers of gelatin with other polymers, albumin, and casein; cellulose derivatives such as hydroxyethylcellulose, carboxymethylcellulose, and cellulose sulfate, and polysaccharides such as sodium alginate and starch derivatives; and various hydrophilic synthetic polymers, for example, homopolymers and copolymers of polyvinyl alcohol, partial acetal-polyvinyl alcohol, poly-N-vinylpyrolidone, polyacrylic acid, polymethyacrylic acid, polyacrylamide, polyvinyl imidazole, and polyvinyl pyrazole.

The gelatins used include a lime-treated gelatin, an acid-treated gelatin, an enzyme-treated gelatin as described in *Bull. Soc. Sci. Phot.* Japan, No. 16 (1966), page 30, a gelatin hydrolyzate, and an enzymatically decomposed gelatin. The gelatin derivatives may be obtained by reacting gelatin with various compounds such as acid halides, acid anhydrides, isocyanates, bromacetic acid, alkane sultones, vinylsulfonamides, maleimides, polyalkylene oxides, and epoxy compounds.

The above-mentioned gelatin graft polymers may be obtained by grafting a homopolymer or copolymer of a vinyl monomer such as acrylic acid, methacrylic acid, their ester or amide derivatives, acrylonitrile, and styrene to gelatin. Preferred among them are graft polymers of gelatin with somewhat compatible polymers such as acrylic acid, methacrylic acid, acrylamide, methacrylamide, hydroxyalkyl methacrylate polymers. Their examples are described in U.S. Pat. Nos. 2,763,625, 2,831,767, and 2,956,884.

The photographic emulsion may be optionally spectrally sensitized if desired, using a cyanine dye including cyanine, merocyanine, and carbocyanine dyes alone or in admixture or a mixture thereof with another dye like a styryl dye.

The photographic light-sensitive material according to the present invention has at least one silver halide emulsion layer on a support, and usually a red-sensitive silver halide emulsion layer, a green-sensitive silver halide emulsion layer, and a blue-sensitive silver halide emulsion layer on a support. Alternatively, the light-sensitive material has a red-sensitive silver halide emulsion layer containing a cyan image-forming coupler, a green-sensitive silver halide emulsion layer containing a magenta image-forming coupler, and a blue-sensitive silver halide emulsion layer containing a yellow image-forming coupler on a support. Of course, the combinations of spectral ranges with couplers is not limited to these examples.

The photosensitive material may contain a water-soluble dyestuff in a hydrophilic colloid layer thereof as a filter dyestuff or various other purposes like irradiation prevention. Some examples of the dyestuffs include oxonol, hemioxonol, styryl, merocyanine, cyanine, and azo dyestuffs. Preferred among them are oxonol, hemioxonol and merocyanine dyestuffs.

The photosensitive material may contain a ultraviolet (UV) radiation absorber in a hydrophilic colloid layer thereof. Useful for this purpose are benzotriazoles having an aryl substituent, 4-thiazolidones, benzophenones, cinnamic esters, butadienes, benzoxazoles, and other UV-absorbing polymers. These UV absorbers may be fixed within the hydrophilic colloid layer.

The photosensitive material may contain a brightener in a photographic emulsion layer or another hydrophilic colloid layer thereof. The brighteners include stilbene, triazine, oxazole, and coumarin derivatives. They may be either soluble or insoluble in water, with water-insoluble ones being used as a dispersion.

When the photosensitive material contains a dyestuff or a UV absorber in a hydrophilic colloid layer thereof, the agents may be mordanted with cationic polymers or other mordants.

The photosensitive material may contain an agent for preventing color fog, including hydroquinone derivatives, aminophenol derivatives, gallic acid derivatives, and ascorbic acid derivatives.

The photosensitive material may contain any well-known discoloration or fade inhibitor. Such color iamge stabilizers may be used alone or in admixture of two or more. Typical examples are hydroquinones, gallic acid derivatives, p-alkoxyphenols, p-oxyphenols and bisphenols.

The photosensitive material may contain any surfactants in a photographic emulsion layer or another hydrophilic colloid layer thereof for various purposes including coating aid, antistatic, lubrication, emulsifying dispersion, anti-adhesion, and improvements in photographic properties (e.g., development acceleration, contrast enhancement, and sensitization). Useful examples of the surfactants include nonionic surfactants, for example, saponins of steroid series, alkyleneoxide derivatives (e.g., polyethylene glycol, polyethylene glycol/-polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicones), glycidol derivatives (e.g., alkenyl succinic acid polyglycerides and alkylphenol polyglycerides), fatty acid esters of polyhydric alcohols, and alkyl esters of saccharides; anionic surfactants having an acidic group such as a carboxy, sulfo, phospho, sulfate ester, and phosphate ester group, for example, alkyl carboxylates, alkyl sulfonates, alkylbenzene sulfonates, alkylnaphthalene sulfonates, alkyl sulfates, alkyl phosphates, N-acyl-N-alkyltaurines, sulfosuccinate esters, sulfoalkyl polyoxyethylene alkylphenyl ethers, and polyoxyethylene alkylphosphate esters; and amphoteric surfactants, for example, amino acids, aminoalkyl sulfonic acids, aminoalkyl sulfates or phosphates, alkylbetains, and amine oxides; cationic surfactants, for example, alkylamine salts, aliphatic or aromatic quaternary ammonium salts, salts of heterocyclic quaternary ammoniums like pyridinium and imidazolium, and aliphatic or heterocyclic phosphonium or sulfonium salts.

The photosensitive material may contain an inorganic or organic hardener in a photographic emulsion layer or another hydrophilic colloid layer thereof. Examples of the hardeners include chromium salts (e.g., chromium alum and chromium acetate), aldehydes (e.g., formaldehyde glyoxal and glutaraldehyde), N-methylols (e.g., dimethylol urea and methylol dimethylhydantoin), dioxanes (e.g., 2,3-dihydroxydioxane), active vinyl compounds (e.g., 1,3,5-triacryloylhexahydro-s-triazine and 1,3-vinylsulfonyl-2-propanol), active halides (e.g., 2,4-dichloro-6-hydroxy-s-triazine), and mucohalogenic acids (e.g., mucochloric acid and mucophenoxychloric acid) alone or in admixture.

The photosensitive material may contain a dispersion of a water-insoluble or difficultly water-soluble synthetic polymer in a photographic emulsion layer or another hydrophilic colloid layer thereof for purposes of dimensional stability and other improvements. These polymers may be polymers having a monomeric unit selected from alkyl (meth)acrylates, alkoxyalkyl (meth-)acrylates, glycidyl (meth)acrylates, (meth)acrylamides, vinyl esters (e.g., vinyl acetate), acrylonitrile, olefins, and styrene alone or mixtures thereof, or combinations thereof with another monomeric unit selected from acrylic acid, methacrylic acid, $\alpha,\beta$-unsaturated dicarboxylic acids, hydroxyalkyl (meth)acrylates, sulfoalkyl (meth)acrylates, and styrene sulfonic acid.

The photographic supports used herein are films usually employed in photographic photosensitive materials, for example, cellulose nitrate films, cellulose acetate films, cellulose acetate butyrate films, cellulose acetate propionate films, polystyrene films, polyethylene terephthalate films, polycarbonate films, laminates, thereof, and laminar glass as well as paper. Good results are obtained with paper sheets having coated or laminated thereon baryta or $\alpha$-olefin polymers, particularly polymers of $\alpha$-olefin having 2 to 10 carbon atoms, such as polyethylene, polypropylene, and ethylene-butene copolymers, and plastic films whose surface is roughened to improve adhesion to another polymer as disclosed in Japanese Patent Publication No. 47-19068.

One typical process belonging to the concept of the present invention produces color images by exposing a silver halide based color photosensitive material to light, and treating it with a combined developing/intensifying solution for simultaneous development and intensification, followed by fixing or bleaching and fixing, washing and drying. The combined developing/intensifying step may be directly followed by stabilization or washing only.

Another typical process belonging to the concept of the present invention produces color images by exposing a silver halide based color photosensitive material to light, treating for color development, and treating for intensification, followed by fixing or bleaching and fixing, washing and drying. The intensifying treatment may be directly followed by stabilization or washing only.

There may be contemplated a further process wherein the coupler is contained in the combined developing/intensifying solution. The couplers which are used as being contained in developing solution are known in the coupler-in-developer type systems, and examples are cyan couplers as described in U.S. Pat. Nos. 3,002,836 and 3,542,552; magenta couplers as described in Japanese Patent Publication No. 44-13111, and yellow couplers as described in U.S. Pat. No. 3,510,306. The coulers are used at concentrations of 0.5 to 5 grams per liter, particularly 1 to 25 grams per liter of developing solution.

Also contemplated is a process involving placing a photosensitive layer on an image receiving layer with a developing/intensifying solution being present therebetween, such that the dye which is rendered movable due to oxidation by the intensifier may diffuse into the image receiving layer. It is also possible that the image receiving layer receives a mobile dye from areas having undergone no oxidation. Images may also be produced by washing out of a mobile dye and a post-treatment of the photosensitive material.

The combined developing/intensifying solution may be a disposable small-volume processing solution which is supplied in small volumes of up to 5 liters per square meter of the photosensitive material and discarded after use.

Light exposure for producing images may be carried out by any conventional well-known methods. Any desired one of various well-known light sources may be used including natural light or day light, tungsten lamps, fluorescent lamps, mercury lamps, xenon arc lamps, carbon arc lamps, xenon flash lamps, and cathode ray tube flying spots. The exposure time may be such exposure times as usually employed in cameras in the range of 1/1000 second to 1 second although exposure times shorter than 1/1000 second, for example, exposure times in the range of $1/10^4$ to $1/10^6$ second may be used with xenon flash lamps and cathode ray tubes and exposure times of more than 1 second may also be used. If necessary, the spectral energy distribution of light used in exposure may be regulated through a color filter. Light exposure may be conducted with laser beams or light emitted from fluorescent bodies excited by electron radiation, x-ray, $\gamma$-ray, or $\alpha$-ray.

In the preferred embodiment of the present invention, the reducing agent, intensifier, and complexing compound all defined above are incorporated into the developing/intensifying solution which is adjusted to a neutral pH level while the silver halide, dye-providing substances such as couplers and substantially water-insoluble basic metal compound all defined above are incorporated in the photosensitive material.

The exposed photosensitive material enters the developing/intensifying solution whereupon a base generates in a layer of the photosensitive material to effect development and intensification. The developing-/intensifying solution which is otherwise relatively unstable is improved in stability to an extent corresponding to a pH decrease and is thus subject to less practical limits. For example, the lifetime of the combined developing/intensifying solution is several folds increased to 15 minutes to 2 hours.

In a preferred combination, the developing/intensifying solution is a 30% solution of hydrogen peroxide intensifier, the substantially water-insoluble basic metal compound is selected from zinc compounds such as $Zn(OH)_2$, ZnO, and basic zinc carbonate, and the complexing compound is a pyridine carboxylate of general formula (I).

The combined developing/intensifying solution may be separated into two parts with the first part containing a reducing agent and the second part containing an intensifier. The complexing compound may be contained in the first and/or second parts. The two parts are mixed before the treatment.

The combined developing/intensifying solution thus prepared by mixing may be used to treat the photosensitive material in various methods, preferably by applying the solution or immersing the photosensitive material in a small volume of the solution which is discarded after use. More illustratively, the combined developing/intensifying solution may be applied to the photosensitive material to a total solution film thickness of up to 300 μm as disclosed in Japanese Patent Application No. 59-202360, or sprayed to the photosensitive material as disclosed in Japanese Patent Application No. 59-202361. In another method as disclosed in Japanese Patent Application No. 59-201148, the photosensitive material is contacted with the combined developing/intensifying solution which is kept in laminar flow conditions or static non-stirred conditions provided that the solution is not used again. Alternatively, the combined developing/intensifying solution may be made more viscous by adding carboxymethyl cellulose (CMC) or hydroxymethyl cellulose for viscous treatment.

The present invention provides a quick, simple, inexpensive color image forming process capable of extending the lifetime of a developing/intensifying solution and accomplishing simultaneously stabilization and simplification of a color intensifying step because a substantially water-insoluble basic metal compound is contacted with a complexing compound to release a base.

EXAMPLES

Examples of the present invention are given below by way of illustration and not by way of limitation.

EXAMPLE 1

A low silver content color photosenstive material designated Sample No. 101 was prepared by coating a paper support having a titanium dioxide-dispersed polyethylene laminated on both the surfaces, with first (lowermost) to sixth (uppermost) layers as formulated below. In the following formulation, a figure expressed in $mg/m^2$ in parentheses designates a coating weight.

6th layer
- Gelatin (1000 $mg/m^2$)

5th (red-sensitive) layer
- Silver chlorobromide AgBrCl emulsion having 30 mol% of silver bromide and an average grain size of 0.2 μm (5 $mg/m^2$ of Ag)
- Gelatin (1000 $mg/m^2$)
- Cyan coupler*1 (400 $mg/m^2$)
- Coupler solvent*2 (200 $mg/m^2$)

4th (UV absorbing) layer
- Gelatin (1200 $mg/m^2$)
- UV absorber*3 (1000 $mg/m^2$)
- Dioctyl hydroquinone (50 $mg/m^2$)

3rd (green-sensitive) layer
- Silver chlorobromide AgBrCl emulsion having 30 mol% of silver bromide and an average grain size of 0.2 μm (5 $mg/m^2$ of Ag)
- Gelatin (1000 $mg/m^2$)
- Magenta coupler*4 (300 $mg/m^2$)
- Coupler solvent*5 (300 $mg/m^2$)

2nd layer
- Gelatin (1000 $mg/m^2$)

1st (blue-sensitive) layer
- Silver chlorobromide AgBrCl emulsion having 80 mol% of silver bromide and an average grain size of 0.4 μm (8 $mg/m^2$ of Ag)
- Gelatin (1200 $mg/m^2$)
- Yellow coupler*6 (300 $mg/m^2$)
- Coupler solvent*2 (150 $mg/m^2$)

Support

*1 Cyan coupler: C-17
*2 Coupler solvent: n-butyl phthalate
*3 UV absorber: 2-(2-hydroxy-3-sec.-butyl-5-tert.-butylphenyl)benzotriazole
*4 Magenta coupler: 1-(2,4,6-trichlorophenyl)-3-[2-chloro-5-tetradecanamide]anilino-2-pyrazolin-5-one
*5 Coupler solvent: o-cresyl phosphate
*6 Yellow coupler: Y-28

Similarly, Sample No. 102 was prepared using the same formulations as Sample No. 101 except that 500 $mg/m^2$ of zinc hydroxide having a particle size of 0.2 to 0.3 μm was further added to each of the second, fourth, and sixth layers.

The photosensitive materials were exposed through a sensitometer and processed by the following sequence of steps.

| Step | Temperature | Time |
|---|---|---|
| Combined development/intensification | 35° C. | 1 min. |
| Post-treatment | 35° C. | 30 sec. |

For the combined development/intensification, photosensitive material Sample Nos. 101 and 102 were treated with the following combined developing/intensifying solutions A and B, respectively.

| Combined developing/intensifying solution A | |
|---|---|
| Potassium sulfite | 4 g |
| Tripotassium phosphate | 40 g |
| Dipotassium phosphate | 6 g |
| 1-Hydroxyethane-1,1-diphosphonic acid | 2 g |
| Benzotriazole | 6 mg |
| 4-Amino-3-methyl-N—ethyl-N—β-(methanesulfonamide)ethylaniline sesquihydrogensulfate | 4 g |
| Hydrogen peroxide (30%) | 20 ml |
| Water totaling to | 1 liter |
| | pH 11.0 |
| **Combined developing/intensifying solution B** | |
| Potassium sulfite | 4 g |
| Potassium picolinate | 35 g |
| 1-Hydroxyethane-1,1-diphosphonic acid | 2 g |
| Benzotriazole | 6 mg |
| 4-Amino-3-methyl-N—ethyl-N—β-(methanesulfonamide)ethylaniline sesquihydrogensulfate | 4 g |
| Hydrogen peroxide (30%) | 20 ml |
| Water totaling to | 1 liter |
| | pH 7.8 |
| **Post-treating solution** | |

-continued

| | |
|---|---|
| 0.1 N hydrochloric acid | 350 ml |
| Sodium citrate dihydrate | 4.4 g |
| Water totaling to | 1 liter |
| | pH 3.2 |

For comparison purposes, the hydrogen peroxide solution was added to the combined developing/intensifying solution immediately before of 30 minutes before the treatment. In either case, the treated sample was dried and measured for the minimum density (Dmin) and the maximum density (Dmax), with the results shown in Table 1.

TABLE 1

| Sample No. | | 101 | | 102 | |
|---|---|---|---|---|---|
| Treating time | | Immediate | After 30' | Immediate | After 30' |
| B | Dmin | 0.13 | 0.10 | 0.13 | 0.12 |
| | Dmax | 2.02 | 1.34 | 2.04 | 1.85 |
| G | Dmin | 0.13 | 0.10 | 0.12 | 0.11 |
| | Dmax | 2.35 | 1.68 | 2.31 | 2.02 |
| R | Dmin | 0.09 | 0.08 | 0.10 | 0.09 |
| | Dmax | 2.55 | 1.72 | 2.60 | 2.14 |
| Remarks | | Comparison | | Invention | |

It is evident that the combined developing/intensifying solution formulated according to the present invention is stable.

EXAMPLE 2

A low silver content color photosensitive material was prepared by coating a paper support having a titanium dioxide-dispersed polyethylene laminated on both the surfaces, with first (lowermost) to sixth (uppermost) layers as formulated below. In the following formulation, a figure expressed in mg/m$^2$ in the parentheses designates a coating weight.

6th layer
- Gelatin (1000 mg/m$^2$)

5th (red-sensitive) layer
- Silver chlorobromide AgBrCl emulsion having 30 mol% of silver bromide and an average grain size of 0.2 μm (5 mg/m$^2$ of Ag)
- Zinc hydroxide (300 mg/m$^2$)
- Gelatin (1000 mg/m$^2$)
- Cyan coupler*1 (400 mg/m$^2$)
- Coupler solvent*2 (200 mg/m$^2$)

4th (UV absorbing) layer
- Gelatin (1200 mg/m$^2$)
- UV absorber*3 (1000 mg/m$^2$)
- Dioctyl hydroquinone (50 mg/m$^2$)

3rd (green-sensitive) layer
- Silver chlorobromide AgBrCl emulsion having 30 mol% of silver bromide and an average grain size of 0.2 μm (5 mg/m$^2$ of Ag)
- Zinc hydroxide (300 mg/m$^2$)
- Gelatin (1000 mg/m$^2$)
- Magenta coupler*4 (300 mg/m$^2$)
- Coupler solvent*5 (300 mg/m$^2$)

2nd layer
- Gelatin (1000 mg/m$^2$)

1st (blue-sensitive) layer
- Silver chlorobromide AgBrCl emulsion having 80 mol% of silver bromide and an average grain size of 0.4 μm (8 mg/m$^2$ of Ag)
- Zinc hydroxide (300 mg/m$^2$)
- Gelatin (1200 mg/m$^2$)
- Yellow coupler*6 (300 mg/m$^2$)
- Coupler solvent*2 (150 mg/m$^2$)

Support

*1 Cyan coupler;
*2 Coupler solvent;
*3 UV absorber;
*4 Magenta coupler;
*5 Coupler solvent;
*6 Yellow coupler are the same as in Example 1.

The photosensitive material was exposed through a sensitometer and processed by the following sequence of steps.

| Step | Temperature | Time |
|---|---|---|
| Combined development/intensification | 35° C. | 1 min. |
| Post-treatment | 35° C. | 30 sec. |

| Combined developing/intensifying solution | |
|---|---|
| Potassium sulfite | 4 g |
| Potassium picolinate | 30 g |
| Dipotassium phosphate | 6 g |
| 1-Hydroxyethane-1,1-diphosphonic acid | 2 g |
| Benzotriazole | 6 mg |
| 4-Amino-3-methyl-N—ethyl-N—β-(methanesulfonamide)ethylaniline sesquihydrogensulfate | 8 g |
| Hydrogen peroxide (30%) | 20 ml |
| Carboxymethyl cellulose (5% in water) | 60 ml |
| Water totaling to | 1 liter |
| | pH 6.8 |
| **Post-treating solution** | |
| 0.1 N hydrochloric acid | 350 ml |
| Sodium citrate dihydrate | 4.4 g |
| Water totaling to | 1 liter |
| | pH 3.2 |

The combined development/intensification step is carried out by spreading the above-formulated developing/intensifying solution (viscous solution) using a spreading roller which was set to provide a clearance of 700 μm between the roller and the photosensitive material. The post-treatment was carried out by immersing the photosensitive material in the solution in a tank.

The photosensitive material processed as above was measured for the minimum density (Dmin) and the maximum density (Dmax), both as reflective density. The results are shown below.

Dmax: at least 1.5 for each of R, G, and B densities
Dmin: up to 0.12 for each of R, G, and B densities Although the developing/intensifying solution had a neutral pH level, images having satisfactory color developing densities could be formed by the present method.

EXAMPLE 3

A photosensitive material having the same composition as Sample No. 102 was prepared by repeating Example 1 except that instead of the zinc hydroxide, 500 mg/m$^2$ of calcium carbonate having an average particle size of 0.3 μm was added to each intermediate layer of the second, fourth, and sixth layers.

A combined developing/intensifying solution was formulated having the same composition as combined developing/intensifying solution B of Example 1 except that instead of the potassium picolinate, 20 grams/liter of potassium oxalate dihydrate was added and the pH adjusted to 8.0.

The above photosensitive material was treated with this combined developing/intensifying solution by substantially the same procedure as in Example 1 to find a satisfactory color developing density.

EXAMPLE 4

A photosensitive material designated Sample No. 201 was prepared by coating the following first and second layers on a paper support laminated on each surface with a polyethylene coating having titanium dioxide dispersed therein. In the following formulation, the coating weight is reported in parentheses.

Second layer

Gelatin (1000 mg/m$^2$)

First layer

Silver chlorobromide emulsion having 30 mol% silver bromide and average grain size 0.2 μm (50 mg/m$^2$ of Ag) Gelatin (1000 mg/m$^2$)

Coupler, 1-(2,4,6-trichlorophenyl)-3-[2-chloro-5-tetradecanamide[anilino-2-pyrazolin-5-one (300 mg/m$^2$) dispersed in o-cresyl phosphate Support Similarly, Sample No. 202 was prepared using the same formulation as Sample No. 201 except that 500 mg/m$^2$ of basic zinc carbonate having a particle size of 0.2 to 0.3 μm was further added to the second layer.

The photosensitive materials were exposed through a sensitometer and processed by the following sequence of steps.

| Step | Temperature | Time |
|---|---|---|
| Color development | 40° C. | 1 min. |
| Intensification with A, B, C or D | 40° C. | 1 min. |
| Post-treatment | 40° C. | 30 sec. |

Intensifying solutions (A-1), (B-1), (C-1) and (D-1) were used to process Sample No. 201 and intensifying solutions (A-2), (B-2), (C-2) and (D-2) used to process Sample No. 202.

| Color developing solution | |
|---|---|
| Benzyl alcohol | 15 ml |
| Diethylene glycol | 10 ml |
| Sodium sulfite | 5 g |
| Potassium bromide | 0.4 g |
| Potassium carbonate | 30 g |
| Hydroxylamine hydrogensulfate | 3 g |
| 4-Amino-3-methyl-N—ethyl-N—β-(methanesulfonamide)ethylaniline sesquihydrogensulfate monohydrate | 10 g |
| Potassium hydroxide | 1.2 g |
| Water totaling to | 1 liter |
| | pH 10.1 |

| Intensifying solution | A-1 | A-2 |
|---|---|---|
| Hydrogen peroxide (30% in water) | 30 ml | 30 ml |
| Sodium carbonate monohydrate | 20 g | 0 g |
| Sodium picolinate | 0 g | 30 g |
| 5-Methylbenzotriazole | 100 mg | 100 mg |
| 1-Hydroxyethane-1,1-diphosphonic acid | 2 g | 2 g |
| Water totaling to | 1 l | 1 l |
| | pH 10.0 | 8.0 |

| Intensifying solution | B-1 | B-2 |
|---|---|---|
| Benzyl alcohol | 15 ml | 15 ml |
| Cobalt hexaammine chloride | 10 g | 10 g |
| Potassium carbonate | 10 g | 0 g |
| Sodium picolinate | 0 g | 15 g |
| Potassium sulfite | 2 g | 2 g |
| Potassium bromide | 2 g | 2 g |
| Diethylenetriamine pentaacetic acid | 10 g | 10 g |
| Water totaling to | 1 l | 1 l |
| | pH 10.1 | 7.6 |

| Intensifying solution | C-1 | C-2 |
|---|---|---|
| Sodium carbonate monohydrate | 25 g | 0 g |
| Sodium bicarbonate 6 | g 0 | g |
| Sodium picolinate | 0 g | 35 g |
| Sodium o-iodosobenzoate | 5 g | 5 g |

-continued

| | | |
|---|---|---|
| 5-Nitrobenzimidazole | 200 mg | 200 mg |
| Water totaling to | 1 l | 1 l |
| | pH 10.0 | 8.0 |

| Intensifying solution | D-1 | D-2 |
|---|---|---|
| Sodium chlorite | 20 g | 20 g |
| 5-Nitrobenzimidazole | 200 mg | 200 mg |
| Sodium carbonate | 10 g | 0 g |
| Sodium picolinate | 0 g | 15 g |
| Diethylenetriamine pentaacetic acid | 2 g | 2 g |
| Water totaling to | 1 l | 1 l |
| | pH 10.0 | 7.6 |

| Post-treating solution | |
|---|---|
| Sodium sulfite | 2 g |
| Sodium bisulfite | 3 g |
| Sodium thiosulfate | 1 g |
| Water totaling to | 1 liter |
| | pH 5.3 |

The photosensitive materials thus processed were dried and measured for the minimum density (Dmin) and the maximum density (Dmax) of magenta. The results are shown in Table 2. The intensifying solutions were aged one day after their preparation and then used in the same processing as above, with the results also reported in Table 2.

TABLE 2

| Sample No. | Intensifying solution | Immediately after preparation Dmin | Immediately after preparation Dmax | Use after 1 day aging Dmin | Use after 1 day aging Dmax | Remarks |
|---|---|---|---|---|---|---|
| 201 | A-1 | 0.11 | 2.32 | 0.18 | 1.92 | Comparison |
| 202 | A-2 | 0.10 | 2.30 | 0.12 | 2.25 | Invention |
| 201 | B-1 | 0.13 | 2.11 | 0.22 | 1.82 | Comparison |
| 202 | B-2 | 0.14 | 2.15 | 0.16 | 2.11 | Invention |
| 201 | C-1 | 0.12 | 2.19 | 0.20 | 1.85 | Comparison |
| 202 | C-2 | 0.11 | 2.17 | 0.13 | 2.10 | Invention |
| 201 | D-1 | 0.10 | 2.14 | 0.19 | 1.86 | Comparison |
| 202 | D-2 | 0.11 | 2.15 | 0.12 | 2.09 | Invention |

EXAMPLE 5

The photosensitive material Sample No. 202 of Example 4 was exposed through a sensitometer and then processed by the following sequence of steps.

| Step | Temperature | Time |
|---|---|---|
| Combined development/intensification A-D | 40° C. | 1½ min. |
| Post-treatment | 40° C. | 30 sec. |

Combined developing/intensifying solutions A-D

| Part I (common among solutions A-D) | |
|---|---|
| Benzyl alcohol | 15 ml |
| Sodium sulfite | 5 g |
| Potassium bromide | 0.4 g |
| Hydroxylamine hydrogensulfate | 3 g |
| Diethylenetriamine pentaacetic acid | 5 g |
| Potassium picolinate | 30 g |
| 4-Amino-3-methyl-N—ethyl—β-(methanesulfonamide)ethylaniline sesquihydrogensulfate monohydrate | 10 g |
| Water totaling to | 1 liter |
| | pH 7.5 |

Part II

Solution A

| | |
|---|---|
| Hydrogen peroxide (30% in water) | 30 ml |
| 5-Methylbenzotriazole | 100 mg |
| 1-Hydroxyethane-1,1-diphosphonic acid | 2 g |
| Water totaling to | 1 liter |
| | pH 7.5 |

Solution B

| | |
|---|---|
| Benzyl alcohol | 15 ml |

-continued

| | |
|---|---|
| Cobalt hexaammine chloride | 10 g |
| Potassium sulfite | 2 g |
| Potassium bromide | 2 g |
| Diethylenetriamine pentaacetic acid | 10 g |
| Water totaling to | 1 liter |
| | pH 7.5 |
| Solution C | |
| Sodium bicarbonate | 6 g |
| o-iodosobenzoic acid | 4 g |
| 5-Nitrobenzimidazole | 200 mg |
| Water totaling to | 1 liter |
| | pH 8.5 |
| Solution D | |
| Sodium chlorite | 20 g |
| 5-Nitrobenzimidazole | 200 mg |
| Diethylenetriamine pentaacetic acid | 2 g |
| Water totaling to | 1 liter |
| | pH 7.5 |

On use, 2 parts by volume of Part I and 1 part by volume of Part II were mixed to form a processing solution.

| Post-treating solution | |
|---|---|
| 0.1 N hydrochloric acid | 350 ml |
| Sodium citrate dihydrate | 4.4 g |
| Water totaling to | 1 liter |
| | pH 3.2 |

The developing/intensifying step was carried out by means of a thin-layer developing machine as disclosed in Japanese patent application No. 59-202360, by applying a processing solution to a thickness of 1.5 mm. The developing/intensifying solution having Part I and Part II mixed in a volume ratio of 2:1 was added to a replenisher tank and supplied to the thin-layer developing machine with the progress of sample development. Samples of the cabinet size were continuously processed one every minute for a total period for 30 minutes. For all combined developing/intensifying solutions A to D, no change of the finished results with time was observed.

EXAMPLE 6

A photosensitive material Sample No. 203 was prepared having the same composition as Sample No. 202 of Example 4 except that the magneta coupler was replaced by a 2-equivalent coupler M-15. Additional photosensitive materials, Sample Nos. 302 and 303 were prepared having the same compositions as Sample Nos. 202 and 203, respectively, except that the amount of silver coated was reduced to 5 mg/m$^2$.

These photosensitive materials, Sample Nos. 202, 203, 302, and 303 were exposed through a sensitometer and then processed by the following sequence of steps using the same processing solutions as in Example 1.

| Step | Temperature | Time |
|---|---|---|
| Combined development/intensification | 35° C. | 50 sec. |
| Post-treatment | 35°. C. | 30 sec. |

The results are shown in Table 3.

TABLE 3

| Sample No. | Combined developing/ intensifying solution | Dmin | Dmax |
|---|---|---|---|
| 202 | A | 0.13 | 2.20 |
| 202 | B | 0.12 | 2.18 |
| 203 | A | 0.15 | 2.36 |
| 203 | B | 0.14 | 2.32 |
| 302 | A | 0.10 | 1.50 |
| 302 | B | 0.09 | 1.46 |
| 303 | A | 0.11 | 1.76 |
| 303 | B | 0.11 | 2.08 |

It is evident that when a 2-equivalent coupler is used, the combined developing/intensifying solution according to the present invention can exert its intensifying effect to a full extent even with a reduced amount of silver.

EXAMPLE 7

A photosensitive material was prepared by coating the following first and second layers on a paper support laminated on each surface with a polyethylene coating having titanium dioxide dispersed therein. In the following formulation, the coating weight is reported in parentheses.

Second layer
- Gelatin (1000 mg/m$^2$)
- Zinc hydroxide having a particle size of 0.2 to 0.3 μm (500 mg/m$^2$)

First layer
- Silver chlorobromide emulsion having 30 mol% silver bromide and average grain size 0.2 μm (20 mg/m$^2$ of Ag)
- Gelatin (1000 mg/m$^2$)
- Magenta dye-providing substance*7 (400 mg/m$^2$)
- High-boiling solvent*8 (200 mg/m$^2$)

Support

*7 Magenta dye-providing substance

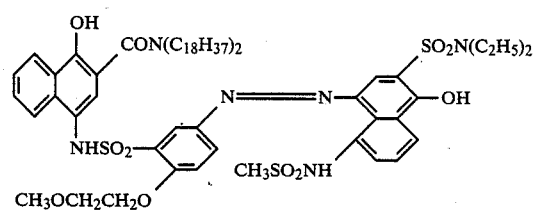

*8 High-boiling solvent: tricresyl phosphate

The photosensitive material was exposed through a sensitometer and then processed by the following sequence of steps.

| Step | Temperature | Time |
|---|---|---|
| Combined development/intensification | 40° C. | 1 min. |
| Water washing | 25° C. | 2 min. |
| Combined developing/intensifying solution | A | B |
| Sodium sulfite | 1 g | 1 g |
| Tripotassium phosphate | 0 g | 30 g |
| Potassium picolinate | 35 g | 0 g |
| 5-Methylbenzotriazole | 50 mg | 50 mg |
| 4-Methyl-4-hydroxymethyl-1-phenyl-3-pyrazolidone | 500 mg | 500 mg |
| 1-Hydroxyethane-1,1-diphosphonic acid | 1.2 g | 1.2 g |
| Hydrogen peroxide (30% in water) | 5 ml | 5 ml |
| Water totaling to | 1 l | 1 l |
| | pH 6.8 | 11.0 |

For comparison purposes, the aqueous hydrogen peroxide was added to the remainder of the combined developing/intensifying solution immediately before and 30 minutes before the treatment of the photosensitive material therewith. In either case, the material was dried after the treatment and measured for the maximum density (Dmax) and the minimum density (Dmin) of a positive image. The results are shown below.

| Combined developing/ intensifying solution | | Dmin | Dmax | Remarks |
|---|---|---|---|---|
| A | Immediate | 0.15 | 2.3 | Invention |
| | After 30' | 0.30 | 2.3 | |
| B | Immediate | 0.16 | 2.2 | Comparison |
| | After 30' | 1.24 | 2.3 | |

It is evident that the present invention is not only effective in dye-forming reaction, but also effective in a color image forming process utilizing dye-releasing reaction.

While the preferred embodiments of the present invention have been described, it is to be understood that modifications and changes will occur to those skilled in the art without departing from the spirit of the invention. The scope of the invention is therefore to be determined solely by the appended claims.

We claim:

1. A process for forming a color image, comprising subjecting an imagewise exposed color photosensitive material comprising at least a silver halide and a coupler to intensified development in the presence of a reducing agent and at least one intensifier, characterized in that said silver halide color photosensitive material contains a substantially water-insoluble basic metal compound therein, and a processing solution containing the intensifier further contains a complexing compound capable of complexing reaction with the metal ion of said substantially water-insoluble basic metal compound to release a base, wherein said complexing compound is selected from aromatic heterocyclic compounds having at least one —COOM group and containing a pyridine or quinoline ring, wherein M is selected from the class consisting of an alkali metal, a guanidine, an amidine and quaternary ammonium.

2. A process for forming a color image, comprising subjecting an imagewise exposed color photosensitive material comprising at least a silver halide and a coupler to intensified development in the presence of a reducing agent and at least one intensifier, characterized in that said silver halide color photosensitive material contains a substantially water-insoluble basic metal compound therein, and a processing solution containing the intensifier further contains a complexing compound capable of complexing reaction with the metal ion of said substantially water-insoluble basic metal compound to release a base, wherein said complexing compound is selected form aromatic heterocyclic compounds having at least one —COOM group and containing one nitrogen atom in their ring, wherein M is selected from the class consisting of an alkali metal, a guanidine, an amidine and quaternary ammonium and wherein the at least one —COOM group is attached to the ring at the α-position thereof relative to the one nitrogen atom in the ring.

3. A process for forming a color image, comprising subjecting an imagewise exposed color photosensitive material comprising at least a silver halide and a coupler to intensified development in the presence of a reducing agent and at least one intensifier, characterized in that said silver halide color photosensitive material contains a substantially water-insoluble basic metal compound therein, and a processing solution containing the intensifier further contains a complexing compound capable of complexing reaction with the metal ion of said substantially water-insoluble basic metal compound to release a base, wherein said complexing compound is selected from compounds having the general formula:

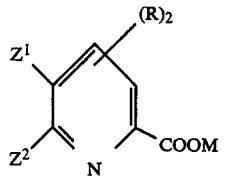

wherein R represents an electron donating radical selected from the class consisting of hydrogen, an aryl radical, a halogen atom, an alkoxy radical, —COOM, a hydroxycarbonyl radical, an amino or substituted amino radical, and an alkyl radical, the two R's may be the same or different, $Z^1$ and $Z^2$ are as defined for R and may combine together to form a ring fused to the pyridine ring, and M is selected from the class consisting of an alkali metal, a guanidine, an amidine, and quaternary ammonium.

4. The image forming process of Claim 1, wherein said intensifier is selected from the class consisting of peroxides, cobalt (III) complexes, halogenous acid salts, and polyvalent iodine compounds; said substantially water-insoluble metal compound is selected from the class consisting of carbonate salts, phosphate sales, silicate salts, borate salts, aluminate salts, hydroxides, oxides, and double salts thereof, provided that they have a solubility in water at 20° C. of 0.5 or less as expressed in grams of the compound dissolved in 100 grams of water; said substantially water-insoluble basid metal compound is present in an amount of 0.01 to 40% by weight of the photosensitive material; said complexing compound is present in an amount of 0.005 to 5 mols per liter of the processing solution; said coupler is a 2-equivalent coupler.

5. The image forming process of claim 2, wherein said intensifier is selected from the class consisting of peroxides, cobalt (III) complexes, halogenous acid salts, and polyvalent iodine compounds; said substantially water-insoluble metal compound is selected from the class consisting of carbonate salts, phosphate sales, silicate salts, borate slts, aluminate salts, hydroxides, oxides, and double salts thereof, provided that they have a solubility in water at 20° C. of 0.5 or less as expressed in grams of the compound dissolved in 100 grams of water; said substantially water-insoluble basic metal compound is present in an amount of 0.01 to 40% by weight of the photosensitive material; said complexing compound is present in an amount of 0.005 to 5 mols per liter of the processing solution; said coupler is a 2-equivalent coupler.

6. The image forming process of claim 2, wherein said intensifier is selected from the class consisting of peroxides, cobalt (III) complexes, halogenous acid salts, and polyvalent iodine compounds; said substantially water-insoluble metal compound is selected from the class consisting of carbonate salts, phosphate sales, silicate salts, borate salts, aluminate salts, hydroxides, oxides, and double salts thereof, provided that they have a solubility in water at 20° C. of 0.5 or less as expressed in grams of the compound dissolved in 100 grams of water; said substantially water-insoluble basic metal compound is present in an amount of 0.01 to 40% by weight of the photosensitive material; said complexing compound is present in an amount of 0.005 to 5 mols per liter of the processing solution; said coupler is a 2-equivalent coupler.

* * * * *

UNITED STATES PATENT AND TRADEMARK OFFICE

CERTIFICATE OF CORRECTION

PATENT NO. : 4,880,725

DATED : November 14, 1989

INVENTOR(S) : HIROYUKI HIRAI ET AL

It is certified that error appears in the above-identified patent and that said Letters Patent is hereby corrected as shown below:

Column 95, Claim 2, line 60, change "form" to --from--.

Column 96, Claim 4, line 43, change "sales" to --salts--.

Column 96, Claim 5, line 60, change "sales" to --salts-- line 61, change "slts" to --salts--.

Column 97, Claim 6, line 8, change "sales" to --salts--.

Signed and Sealed this

Nineteenth Day of March, 1991

*Attest:*

HARRY F. MANBECK, JR.

*Attesting Officer*

*Commissioner of Patents and Trademarks*